US006838048B2

(12) United States Patent
Nishi et al.

(10) Patent No.: US 6,838,048 B2
(45) Date of Patent: Jan. 4, 2005

(54) STEEL FOR MACHINE STRUCTURAL USE AND METHOD OF PRODUCING SAME

(75) Inventors: Takayuki Nishi, Kashima (JP); Hitoshi Matsumoto, Kitakyushu (JP); Toru Kato, Kashima (JP); Koji Watari, Kobe (JP); Naoki Matsui, Amagasaki (JP); Hiroaki Tahira, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 143 days.

(21) Appl. No.: 10/259,744

(22) Filed: Sep. 30, 2002

(65) Prior Publication Data

US 2003/0084965 A1 May 8, 2003

(30) Foreign Application Priority Data

Oct. 1, 2001 (JP) ..... 2001-305314
Apr. 15, 2002 (JP) ..... 2002-112457

(51) Int. Cl.[7] ..... C22C 38/60; C22C 38/02; C22C 38/04

(52) U.S. Cl. ..... 420/84; 420/87

(58) Field of Search ..... 420/84, 87

(56) References Cited

U.S. PATENT DOCUMENTS 5,213,633 A * 5/1993 Hada et al. ..... 148/334
6,764,645 B2 * 7/2004 Hayaishi et al. ..... 420/125

FOREIGN PATENT DOCUMENTS

JP 57-140853 8/1982
JP 62-103340 5/1987
JP 5-15777 3/1993
JP 11-222646 8/1999
JP 2000-34537 2/2000
JP 2000-219936 8/2000
JP 2000-282171 10/2000

OTHER PUBLICATIONS

Denki–Seiko (Electric Furnace Steel), vol. 44, No. 1, pp. 81–88, Jan. 1973.

* cited by examiner

*Primary Examiner*—Deborah Yee
(74) *Attorney, Agent, or Firm*—Clark & Brody

(57) ABSTRACT

A steel for machine structural use which comprises, on the percent by mass basis, C: 0.1 to 0.6%, Si: 0.01 to 2.0%, Mn: 0.2 to 2.0%, S: 0.005 to 0.20%, P: not more than 0.1%, Ca: 0.0001 to 0.01%, N: 0.001 to 0.02% and Al: not more than 0.1%, with the balance being Fe and impurities, with a value of [Ca]e defined by $[Ca]e=T.[Ca]-(T.[O]/(O)_{ox})\times(Ca)_{ox}$ of not more than 5 ppm or with a proportion of MnO contained in oxide inclusions of not more than 0.05 and a value of Ca/O of not more than 0.8 is excellent in machinability and, therefore, it can be used as a steel stock for various machine structural steel parts, such as in industrial machinery, construction machinery and conveying machinery such as automobiles. It is substantially free of Pb, hence suited for use as a steel friendly to the global environment. [Ca]e is the effective Ca concentration index (ppm by mass), T.[Ca] and T.[O] are the contents of Ca and O, respectively, in ppm by mass, and $(O)_{ox}$ and $(Ca)_{ox}$ are the proportions of O and Ca contained in oxide inclusion, respectively.

8 Claims, 14 Drawing Sheets

STEEL FOR MACHINE STRUCTURAL USE AND METHOD OF PRODUCING SAME

This application claims priority under 35 U.S.C. §§ 119 and/or 365 to Japanese Patent Application Nos. 2001-305314 and 2002-112457 filed in Japan on Oct. 1, 2001 and Apr. 15, 2002, respectively, the entire content of which is herein incorporated by reference.

FIELD OF THE INVENTION

The present invention relates to a steel for machine structural use, or structural steel for short, excellent in machinability, in particular a structural steel showing very good chip separability, which is required in automated working lines, in spite of its being Pb-free, and prolonging the life of carbide tools when machined by such tools, and to a method of producing the same.

BACKGROUND OF THE INVENTION

Various machine structural steel parts used in industrial machinery, construction machinery, conveying machinery such as automobiles, and the like are often produced by roughly working a steel for machine structural use to a predetermined form or shape by hot working, such as hot forging, and then finishing the same to a desired form or shape by machining. Accordingly, the steel for machine structural use has been required to have not only good mechanical properties but also high machinability.

With the advances in automated high-speed machining steps in recent years, the demand for structural steels excellent in machinability, in particular structural steels, not only excellent in chip separability but also enabling carbide tools used in machining them to secure a long tool life, has been increasing for stably realizing safety and high productivity.

According to the prior art, Pb (lead) is added to improve the separability of chips of steels for machine structural use. In view of the recent increasing concern about environmental problems, however, structural steels showing good chip separability without addition of Pb are desired.

Well known Pb-free structural steels, having machinability when subjected to machining with carbide tools, are calciumized free cutting steels. In calciumized free cutting steels, low-melting-point oxides are formed and these protect the carbide tools and prolong the tool life.

However, as described in DENKI-SEIKO (ELECTRIC FURNACE STEEL), Vol. 44, No. 1, pp. 81 to 88, for instance, calciumized free cutting steels are poor in chip separability as compared with leaded free cutting steels. Therefore, the combined use of a chip separability-increasing element, such as S (sulfur), is necessary, and calciumized and resulfurized free cutting steels have generally been used. In the case of calciumized and resulfurized free cutting steels, however, oxide morphology control is carried out and, accordingly, the substantial oxygen content increases and coarse sulfides are formed in some instances, leading to failure to secure good chip separability. Thus, it is difficult to stably increase the chip separability of Pb-free steels.

In laid-open Japanese Patent Application (JP-A) No. H11-222646, a structural steel excellent in chip separability is disclosed which has a substantially Pb-free composition and is characterized in that there exist individual sulfide inclusions not shorter than 20 $\mu$m, or groups of a plurality of sulfide inclusions linked together in an approximately linear manner and not shorter than 20 $\mu$m in a section in the direction of rolling in a density of 30 or more per square millimeter. However, for producing this steel, it is necessary to modify not only the steelmaking conditions but also the rolling conditions, and this technology is therefore under severe restrictions.

JP-A No. 2000-219936 proposes a free cutting steel having a specified composition and characterized in that it contains 5 or more sulfide inclusions, containing 0.1 to 10% of calcium and having a circle equivalent diameter of 5 $\mu$m or larger per 3.3 square millimeters. However, since the aim of the invention disclosed in this publication was to improve the material anisotropy and tool life by dispersing sulfide inclusions containing not more than 10% of CaS in the MnS, no attention has been paid to the improvement in chip separability.

JP-A No. 2000-282171 discloses a structural steel excellent in chip separability and characterized in that it has a substantially Pb-free composition and also has a sulfide grain distributing index of not more than 0.5. However, calculations, made by the present inventors, of the sulfide grain distribution indices, as proposed in the above-cited publication, for the common steels grade S1 and grade S2 improved in machinability, as described in the Japanese Automobile Standards Organization standard JASO M 106-92 (established May 28, 1977 and revised Mar. 30, 1992 by the Society of Automotive Engineers of Japan), failed to find such steel species that have the desired mechanical characteristics and machinability under which the index in question has a value of 0.5 or lower.

JP-A No. S57-140853 discloses a "calciumized and resulfurized free cutting steel, restricted in soluble Al content to 0.002 to 0.005% by weight and in O (oxygen) content to 0.0040% by weight or less, and containing not more than 0.0150% by weight of Ca within the range of (Ca %−0.7×O %)/S %≧0.10 (% being % by weight)". This calciumized and resulfurized free cutting steel indeed makes it possible to accomplish the purposes of preventing sulfide extension and securing low-melting-point oxides simultaneously and, therefore, is effective in improving the tool life. However, when the Ca content is high and exceeds 0.01%, coarse sulfide inclusions may be formed and, therefore, good chip separability cannot always be obtained simultaneously.

Japanese Patent Publication (JP-B) No. H05-15777 discloses a "calciumized and resulfurized free cutting steel containing 0.015 to 0.060% by weight of Al with the O (oxygen) content being 20 ppm or less" for deoxidation and grain size control. The calciumized and resulfurized free cutting steel proposed in this publication is indeed improved in chip separability as compared with S-containing free cutting steels and Ca-containing oxide controlled steels, but from the chip separability viewpoint, it is still inferior to Pb-containing free cutting steels.

SUMMARY OF THE INVENTION

It is an object of the present invention to provide a steel for machine structural use which is substantially free of Pb, shows good chip separability required in automated working lines and prolongs the life of carbide tools when machined by such tools, and a method of producing the same.

Here, the goal to be attained with respect to machinability is to secure a level of machinability which is equal to that of the steels grade L1 and grade L2 described in the above-cited automobile standards JASO M 106-92, namely free cutting steels containing about 0.04 to 0.30% by mass of Pb.

More specifically, the goal to be reached with respect to "chip separability" in turning, for instance, is to satisfy the requirement that the mass per 10 typical chips should amount to not more than 20 g when turning is carried out under the turning conditions to be mentioned later herein, namely using a P20 carbide tool tip under dry lubrication at a depth of a cut of 2.0 mm, a feed rate of 0.25 mm/rev. and a cutting speed of 132 to 160 m/min.

The goal to be achieved with respect to "chip separability" in drilling is to meet the requirement that the mass per 100 typical chips should amount to not more than 1.3 g when 50-mm-deep holes are made under the drilling conditions to be mentioned later herein, namely using an ordinary high speed steel drill with a diameter of 5 mm and, as a lubricant, a water-soluble cutting fluid (emulsion type) W1 as specified in JIS K 2241 at a feed rate of 0.15 mm/rev. and a cutting speed of 18.5 m/min.

The goal with respect to "tool life" is, for example, such that when turning is carried out under the above-described conditions, the time until the flank wear amounts to 0.2 mm is not shorter than 15 minutes.

Main points of the present invention are as follows:

(I) A steel for machine structural use which comprises, on the percent by mass basis, C: 0.1 to 0.6%, Si: 0.01 to 2.0%, Mn: 0.2 to 2.0%, S: 0.005 to 0.20%, P: not more than 0.1%, Ca: 0.0001 to 0.01%, N: 0.001 to 0.02% and Al: not more than 0.1%, with the balance being Fe and impurities, the effective Ca concentration index defined by the formula (1) given below being not more than 5 ppm by mass:

$$[Ca]e=T.[Ca]-(T.[O]/(O)_{ox})\times(Ca)_{ox} \quad (1)$$

in which the symbols are defined as follows:

[Ca]e: effective Ca concentration index (ppm by mass);

T.[Ca]: Ca content in ppm by mass;

T.[O]: O (oxygen) content in ppm by mass;

$(O)_{ox}$: proportion of O (oxygen) contained in oxide inclusions;

$(Ca)_{ox}$: proportion of Ca contained in oxide inclusions.

(II) A steel for machine structural use which comprises, on the percent by mass basis, C: 0.1 to 0.6%, Si: 0.01 to 2.0%, Mn: 0.2 to 2.0%, S: 0.005 to 0.20%, P: not more than 0.1%, Ca: 0.0001 to 0.01%, N: 0.001 to 0.02% and Al: not more than 0.1%, with the balance being Fe and impurities, the proportion of MnO contained in oxide inclusions being not more than 0.05 and the relation of the formula (2) given below being satisfied:

$$Ca/O \leqq 0.8 \quad (2)$$

in which the symbols of elements represent the contents of the respective elements in the steel as expressed on the percent by mass basis.

(III) A method of producing the steel for machine structural use described above under (I) which comprises adding calcium to a molten steel having a chemical composition as described above under (I) but containing no calcium while stirring the molten steel under conditions such that the stirring energy defined by the formula (3) given below amounts to not more than 60 W/t and under conditions such that the value of A defined by the formula (4) given below amounts to not more than 20, and subjecting the resulting molten steel to continuous casting:

$$\epsilon=\{(371\times Q\times T_L)/W_L\}\times\ln\{1+(9.8\times\rho\times H)/P\}+\{1-(T_G/T_L)\} \quad (3)$$

$$A=\alpha/\epsilon \quad (4)$$

where the symbols in the formulas (3) and (4) are defined as follows:

$\epsilon$: stirring energy per ton of molten steel (W/t);

Q: amount of gas blown into molten metal ($m^3$ (normal)/s);

$T_L$: molten steel temperature (K);

$W_L$: amount of molten metal (t);

$\rho$: density of molten metal ($7\times10^3$ $kg/m^3$);

H: depth of gas blown into molten steel (m);

P: pressure of atmosphere ($N/m^2$);

$T_G$: blown gas temperature (K);

$\alpha$: Ca addition amount per ton of molten steel (g/t).

The "proportion of O (oxygen) contained in oxide inclusions", "proportion of Ca contained in oxide inclusions" and "proportion of MnO contained in oxide inclusions" mean the "proportion of O (oxygen)", "proportion of Ca" and "proportion of MnO", respectively, relative to the "mass of all oxide inclusions which is taken as 1".

For improving such mechanical properties as tensile strength and toughness of the steel for machine structural use as defined above in (I) or (II), part of Fe may be replaced by one or more elements selected from among Ti: not more than 0.1%, Cr: not more than 2.5%, V: not more than 0.5%, Mo: not more than 1.0%, Nb: not more than 0.1%, Cu: not more than 1.0% and Ni: not more than 2.0%.

For further improving the machinability of the steel for machine structural use as defined above in (I) or (II), part of Fe may be replaced by one or more elements selected from among Se: not more than 0.01%, Te: not more than 0.01%, Bi: not more than 0.1%, Mg: not more than 0.01% and REM (rare earth elements): not more than 0.01%. The "REM (rare earth elements)" is a generic name for a total of 17 elements including Sc, Y and lanthanoids, and the above content of REM means the total content of the elements mentioned above.

DETAILED DESCRIPTION OF THE INVENTION

Figure 1:
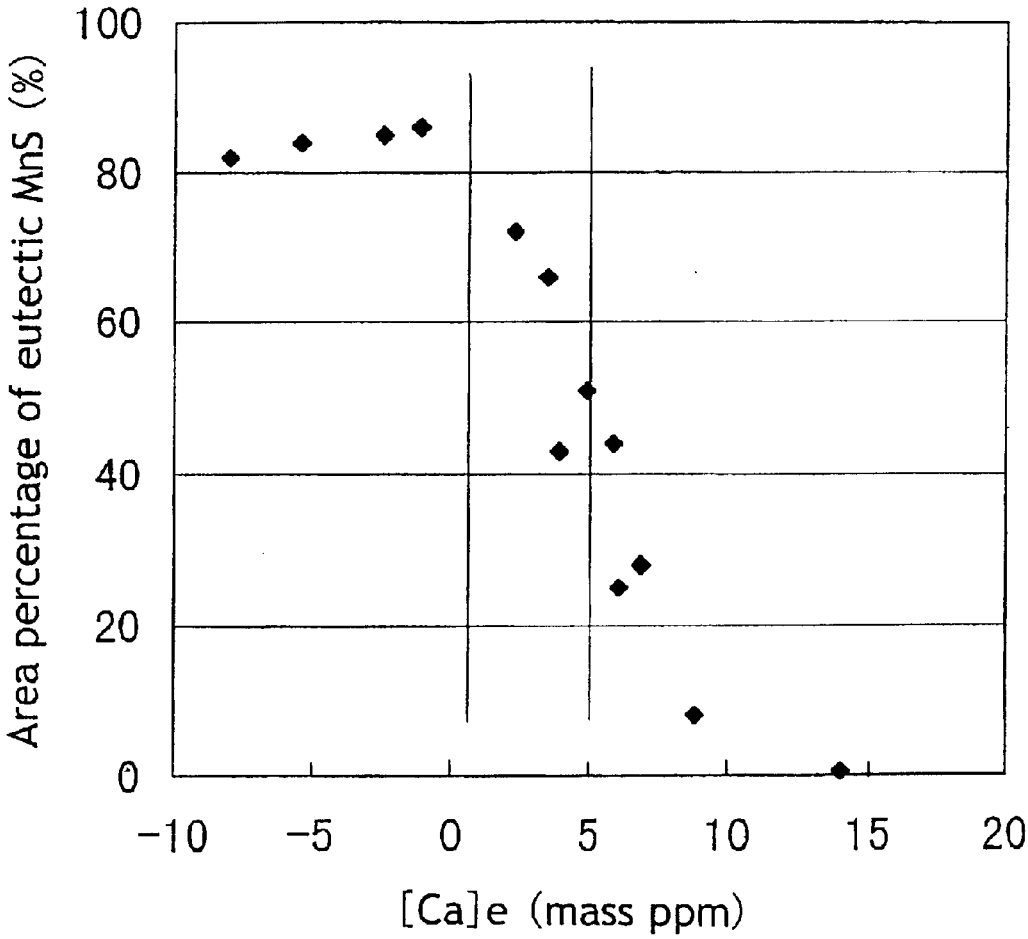
FIG. 1 is a graphic representation of the relationship between effective Ca concentration index [Ca]e and area percentage of eutectic MnS type sulfides.

The present inventors made investigations concerning the chip separability of steel species derived from steels for machine structural use with a substantially Pb-free chemical composition by adding Ca and S, which are well known as machinability-improving elements, namely calciumized and resulfurized free cutting steel species.

As a result, it was found that even when the chemical composition is almost constant and the hardness and strength remain on the same level, the machinability, in particular chip separability, may markedly vary depending on the morphology of sulfides.

Further investigations revealed that the chip separability is dominated by the state or mode of distribution of sulfides, among which MnS is the main constituent compound, dispersed in the calciumized and resulfurized free cutting steels (hereinafter such sulfides are referred to as "MnS type sulfides"), and the following findings (a) to (g) were obtained.

(a) Individual grains of MnS type sulfides are dispersed uniformly as such in some cases or gather and form colonies in other cases. When they form colonies, which are, in turn, dispersed uniformly, the chip separability is better than the case where individual grains are dispersed uniformly. The reason for this may be because individual MnS type sulfide grains are elongated and divided according to the reduction of area in rolling, as expressed in terms of sectional area ratio, for instance, while colony-forming MnS type sulfide grains undergo changes only according to the metal flow.

(b) The formation and dispersion of colony-forming MnS type sulfides can be associated with the formation and dispersion of the so-called "eutectic MnS type sulfides" resulting from almost simultaneous crystallization of MnS type sulfides and the δ ferrite phase, or MnS type sulfides and the austenite phase, in which, during the microsegregation of solidification process, the ratio of solid phase is high.

It has been known since long ago that eutectic MnS type sulfides are formed upon changes in chemical composition of molten steel and/or remarkable changes in rate of solidification. However, no technology has yet been established for the formation and dispersion of eutectic MnS type sulfides within the practical range of chemical compositions of calciumized and resulfurized free cutting steels for machine structural use and within the practical range of rates of solidification with a view to continuous casting.

(c) The morphology of MnS type sulfides is influenced not only by the contents of Mn and S forming them, but also by the content of O (oxygen), which has an influence on the interfacial energy, and by the content of Ca, which has a great influence on the activities of S and O.

(d) Generally, the O content and Ca content revealed by chemical analysis are the total O (oxygen) content and total Ca content in steel. Thus, these contents are not the contents of dissolved O (oxygen) and dissolved Ca, which really do exert influences in the morphology of MnS type sulfides. However, it is very difficult to determine the contents of dissolved O and dissolved Ca occurring in dendrite arm spaces in the process of solidification. Therefore, the present inventors employed the concept of effective Ca concentration index [Ca]e as means for grasping the contents of dissolved O and dissolved Ca based on the O content and Ca content which can actually be measured. By adjusting this effective Ca concentration index [Ca]e to a level within a specific range, it has now become possible to cause the formation and dispersion of eutectic MnS type sulfides in a stable and trustworthy manner with an area percentage of not less than 40%, as mentioned later herein, even when calciumized and resulfurized free cutting steels, whose chemical composition is within the practical range, are produced at an ordinary rate of continuous casting. Thus, the steels can be provided with high chip separability.

In the formula (1), which defines the effective Ca concentration index [Ca]e, T.[O] and T.[Ca] indicate the O content and Ca content in ppm by mass, respectively, and $(O)_{ox}$ and $(Ca)_{ox}$ denote the "proportion of O" and "proportion of Ca" with the "mass of oxide inclusions being taken as 1", respectively, as mentioned above.

(e) On the other hand, as can be seen from the above findings (a) and (b), the chip separability is improved with the increase in the yield of eutectic MnS type sulfides. This is because the eutectic MnS type sulfides occur as aggregates of fine MnS type sulfides whose aggregates are covered with a layer which has a lower concentration of Mn than in the average steel composition. Therefore, they can produce a higher notch effect compared to individual MnS type sulfides precipitate as dispersed randomly.

(f) The amount or yield of eutectic MnS type sulfides also depends on the ratio between Ca content and O (oxygen) content (i.e. value of "Ca/O") and the proportion of MnO contained in oxide inclusions. By adjusting these values so that they may fall within respective specific ranges, it becomes possible to stably and assuredly secure a yield of not less than 40%, as expressed in terms of area percentage, as mentioned later herein, of eutectic MnS type sulfides in calciumized and resulfurized free cutting steels, which have a chemical composition within a specific range in a practical production process, and thus provide high chip separability.

(g) When the Ca content is 0.0001 to 0.0048% and the O (oxygen) content in impurities is 0.002 to 0.006%, the morphology of eutectic MnS type sulfides can be controlled with more certainty and therefore calciumized and resulfurized free cutting steels, within a practical range from the chemical composition viewpoint, can be provided with high chip separability more stably and more assuredly.

The aspects of the invention concerning a "steel for machine structural use" as mentioned above under (I) and (II) have been completed based on the above findings.

On the other hand, the present inventors made investigations in search of a method of steelmaking for adjusting the effective Ca concentration index [Ca]e to a desired value. In a small-sized experimental apparatus, the O content can be stabilized at a low level and the yield in Ca treatment can be anticipated so that a desired effective Ca concentration index [Ca]e can be attained by modifying the levels of addition of alloying components and also by changing the order of addition. In the production in a large-sized plant, however, it is difficult to attain a desired value by such contrivances alone.

Therefore, the present inventors made investigations concerning the effective Ca concentration index [Ca]e and the eutectic MnS type sulfides dispersed in blooms while taking into consideration a steelmaking process comprising the steps of melting in a basic oxygen furnace or electric furnace, secondary refining and continuous casting.

As a result, it was found that the steel for machine structural use as mentioned under (I) can be readily obtained when the chemical composition of the molten steel is controlled and the molten steel stirring conditions and the Ca addition level in secondary refining are optimized.

The aspect of the invention relating to the "method of producing steels for machine structural use" as mentioned above under (III) has also been completed based on the above findings and it shows a preferred mode in the production of the steel for machine structural use as mentioned above under (I) using large-sized equipment.

In the following, the elements of the present invention are described in detail.

First, the chemical composition of the steel for machine structural use according to the present invention and the reasons for restriction thereof are explained. In the following description, the "%" values given for the contents of respective elements are "% by mass" values, and "ppm" means "ppm by mass".

C: 0.1 to 0.6%

C is an element necessary to secure the tensile strength of steel and can provide steel with a level of toughness required of a steel for machine structural use, so that its content should be not less than 0.1%. On the other hand, when its content exceeds 0.6%, the matrix machinability, which is a prerequisite for free cutting properties, is impaired. Therefore, the content of C should be 0.1 to 0.6%.

Si: 0.01 to 2.0%

Si is an element having deoxidizing and solid-solution strengthening effects. For producing these effects, the Si content is required to be not less than 0.01%. However, when the content exceeds 2.0%, the solid-solution strengthening becomes excessive. Therefore, the content of Si should be 0.01 to 2.0%. A more preferred Si content is 0.1 to 1.0%.

Mn: 0.2 to 2.0%

Mn is an element effective in increasing the chip separability by forming eutectic MnS type sulfides and in improving the hardenability and thereby increasing the tensile strength of steel. Mn also has a deoxidizing effect. When the Mn content is insufficient, the amount of FeS increases to cause embrittlement. Therefore, the Mn content is required to be not less than 0.2%. When the Mn content exceeds 2.0%, however, the hardenability becomes excessive and the machinability is thus impaired. Therefore, the content of Mn should be 0.2 to 2.0%. A more preferred Mn content is 0.4 to 2.0%.

S: 0.005 to 0.20%

S is an element effective in the machinability, in particular chip separability, of steel by forming eutectic MnS type sulfides. For producing this effect, the content of S is required to be not less than 0.005% and, in particular when the S content is 0.01% or more, the above effect becomes prominent. On the other hand, when its content exceeds 0.20%, cracking may occur during forging, or the deterioration in mechanical properties such as material anisotropy becomes significant, hence the steel is no more suited for general applications. Therefore, the content of S should be 0.005 to 0.20%. A more preferred S content is 0.01 to 0.18%.

P: not more than 0.1%

P causes a deterioration in toughness or a reduction in ductility. In particular when its content is over 0.1%, the toughness deterioration or ductility reduction is significant. On the other hand, P is effective in increasing the tensile strength and fatigue strength by its solid-solution strengthening effect, and this effect can be secured at a P content of 0.04% or more. In cases where both the tensile strength and fatigue strength are desired to be increased, P may be added to a level of 0.04% or more. However, when P is added at a level exceeding 0.1%, the above-mentioned deterioration in toughness and/or reduction in ductility increases. Therefore, the content of P should be not more than 0.1%. A preferred P content is not more than 0.05%.

Ca: 0.0001 to 0.01%

Ca is an element essential for the improvement in machinability and for the morphological control of sulfides. Thus, when existing in steel in a state contained in oxide inclusions, Ca produces a machinability-improving effect and, in particular, an effect of suppressing the wear of carbide tools in high speed machining. Furthermore, Ca has a high affinity for O (oxygen) and S, hence is an element which is important as an MnS type sulfide morphology controlling factor. Although the MnS type sulfide morphology controlling effect is produced even when the Ca content is very low, a Ca content less than 0.0001% is insufficient to contribute to machinability improvement. On the other hand, when the Ca content is over 0.01%, the above effect is already at a point of saturation and the increase is excessive. Therefore, the content of Ca should be 0.0001 to 0.01%. A more preferred Ca content is 0.0001 to 0.0048%.

N: 0.001 to 0.02%

N forms nitrides and makes grains finer and thus is effective in improving the toughness and fatigue characteristics. For securing the above effects of nitrides, it is necessary that the content of N should be not less than 0.001%. When the content of N exceeds 0.02%, however, nitride grains become coarse, which could cause a deterioration in toughness. Therefore, the content of N should be 0.001 to 0.02%. A more preferred N content is 0.002 to 0.02%.

Al: not more than 0.1%

Al is an element effective in deoxidation of steel. According to the present invention, Si and Mn are used at the respective addition levels already mentioned hereinabove and, therefore, deoxidation can be accomplished by the use of Si and Mn. Thus, deoxidizing treatment with Al is not particularly required, hence the addition of Al may be omitted. However, positive addition of Al increases the effect of deoxidation and, at the same time, makes austenite grains finer through nitride formation and thus produces a toughness improving effect. These effects can be attained with an Al content of 0.010% or more. Therefore, when the deoxidizing effect and toughness improving effect are desired, Al may be added to a level of 0.010% or more. However if Al content exceeds 0.1%, the deoxidizing effect is almost at a point of saturation, and nitride grains become coarse and could cause a reduction in toughness. Therefore, the content of Al should be not more than 0.1%.

Whether Al is added or not added as a deoxidizing agent, the Al content of 0.0003 to 0.005% softens oxide inclusions and can prolong the tool life under high speed cutting conditions. Therefore, in the case if it is desired to prolong the tool life under high-speed cutting conditions, the Al content may be selected at 0.0003 to 0.005%. The control of such a trace amount of Al can be accomplished, for example, by adjusting the Al addition level, while taking into consideration the amount of Al contained in the FeSi ferroalloy or CaSi ferroalloy, or by adjusting the $Al_2O_3$ content in slag or restricting the $Al_2O_3$ content in the refractory material while considering the reactivity of $Al_2O_3$ with the molten steel and slag and/or refractory material.

The steels for machine structural use as described above under (I) and (II) have the above-mentioned chemical constituents with the balance consisting of Fe and impurities.

As already mentioned above, part of Fe may be replaced by one or more elements selected from among Ti: not more than 0.1%, Cr: not more than 2.5%, V: not more than 0.5%, Mo: not more than 1.0%, Nb: not more than 0.1%, Cu: not more than 1.0% and Ni: not more than 2.0% for improving such mechanical properties as tensile strength and toughness of the steels for machine structural use as described above under (I) and (II).

It is generally known that when the tensile strength of steel is increased, the machinability thereof decreases. However, all the above-mentioned elements, from Ti to Ni, when contained at the respective appropriate addition levels, produce an effect of increasing the tensile strength of steel, without interfering with the machinability-improving effect of the morphology control of MnS type sulfides to be mentioned later. These elements, from Ti to Ni, may be added singly or in combination within the content limits mentioned below.

Ti: not more than 0.1%

Ti forms the carbide, nitride and carbonitride and makes grains finer, so that the tensile strength of steel is increased and the toughness is also improved. For securing these effects, the content of Ti is preferably not less than 0.005%. However, when its content exceeds 0.1%, the above effects reach points of saturation and, in addition, the amount of hard TiN and the like increases and the machinability is thereby decreased. Therefore, the content of Ti, when it is added, is recommendably not higher than 0.1%.

Cr: not more than 2.5%

Cr is an element useful in increasing the tensile strength of steel. For securing this effect, the content of Cr is desirably not less than 0.03%. However, when its content exceeds 2.5%, the machinability markedly decreases. Therefore, the content of Cr, when it is added, is recommendably not more than 2.5%.

V: not more than 0.5%

V, like Ti, forms the carbide, nitride and carbonitride and makes grains finer and, accordingly, the tensile strength is increased and the toughness thereof is also improved. For securing these effects, the content of V is preferably not less than 0.05%. However, when its content exceeds 0.5%, the above effects arrive at respective points of saturation and, in addition, the machinability markedly decreases. Therefore, the content of V, when it is added, is recommendably not more than 0.5%.

Mo: not more than 1.0%

Mo is an element useful in increasing the tensile strength of steel. For securing this effect, the content of Mo is desirably not less than 0.05%. However, when its content exceeds 1.0%, the microstructure, after hot working, becomes abnormally coarse and the toughness decreases accordingly. Therefore, the content of Mo, when it is added, is recommendably not more than 1.0%.

Nb: not more than 0.1%

Nb forms the carbide, nitride and carbonitride and thus makes grains finer, so that the tensile strength of steel is increased and the toughness is improved. For securing these effects, the content of Nb is preferably not less than 0.005%. However, when its content exceeds 0.1%, the above effects reach points of saturation and, in addition, marked decreases in machinability will result. Therefore, the content of Nb, when it is added, is recommendably not more than 0.1%.

Cu: not more than 1.0%

Cu is effective in increasing the tensile strength of steel by precipitation strengthening. For securing this effect, it is preferable the content of Cu be not less than 0.2%. However, when its content exceeds 1.0%, the hot workability is deteriorated and, in addition, precipitates may become coarse and the above effect may be saturated, or under some circumstances, it may be decreased. Furthermore, the cost will rise. Therefore, the content of Cu, when it is added, is recommendably not more than 1.0%.

Ni: not more than 2.0%

Ni is effective in increasing the tensile strength of steel by solid solution strengthening. For securing this effect, the Ni content is preferably not less than 0.2%. However, when the content of Ni exceeds 2.0%, the above effect reaches a point of saturation and there is an increase in cost. Therefore, the content of Ni, when it is added, is recommendably not more than 2.0%.

As already mentioned above, part of Fe in the steels for machine structural use as defined above under (I) and (II) may be replaced by one or more elements selected from among Se: not more than 0.01%, Te: not more than 0.01%, Bi: not more than 0.1%, Mg: not more than 0.01% and REM (rare earth elements): not more than 0.01% so that the machinability of the steels may further be improved.

The elements mentioned above, from Se to REM, when contained at the respective appropriate levels, further improve the machinability, without adversely affecting the chip separability improving effect of MnS type sulfides as produced by morphological control, as mentioned later herein. The elements from Se to REM may be contained singly or in combination of two or more, in the respective ranges mentioned below.

Se: not more than 0.01%

Se is an element belong to the same group as S in the periodic table of the elements and forms (S,Se)Mn. In the practice of the present invention, Se contributes to morphological control of MnS type sulfides and, when added at a low level, prevents elongation of the MnS type sulfides during hot rolling, without adversely affecting the effect of morphological control of the MnS type sulfides, hence Se shows an effect of further improving the machinability of steel at the same S content level. For securing the machinability-improving effect of Se, its content is desirably not less than 0.001%. However, when its content exceeds 0.01%, the above effect reaches a point of saturation and the increase in cost is excessive. Therefore, the content of Se, when it is added, is recommendably not more than 0.01%.

Te: not more than 0.01%

Te is an element belonging to the same group as S in the periodic table and forms (S,Te)Mn. In the practice of the present invention, Te contributes to morphological control of MnS type sulfides and, when added at a low level, prevents elongation of the MnS type sulfides during hot rolling, without adversely affecting the effect of morphological control of the MnS type sulfides, hence Te produces an effect of further improving the machinability of steel at the same S content level. For securing the machinability-improving effect of Te, its content is desirably not less than 0.001%. However, when the content of Te exceeds 0.01%, the above effect reaches a point of saturation and the increase in cost is excessive. Therefore, the content of Te, when it is added, is recommendably not more than 0.01%.

Bi: not more than 0.1%

Bi is an element effective in further increasing the machinability of steel. Bi precipitates around the MnS type sulfides, forming complexes and prevents the elongation of MnS type sulfides during hot rolling. The MnS type sulfide elongation preventing effect is obtained in combination with the morphological control of MnS type sulfides, in accordance with the present invention, whereby the machinability of steel is further improved at the same S content level. For securing the machinability-improving effect of Bi, its content is preferably not less than 0.01%. However, when its content exceeds 0.1%, the above effect reaches a point of saturation and, in addition, the cost increases. Therefore, the content of Bi, when it is added, is recommendably not more than 0.1%.

Mg: not more than 0.01%

Mg is effective in further increasing the machinability of steel. Thus, Mg is a strong deoxidizing element and therefore forms MgO or MgO—$Al_2O_3$ type inclusions. However, it does not have bad influence on the morphological control of MnS type sulfides. MnS type sulfides are formed with such oxide inclusions as nuclei for crystallization, so that the MnS type sulfides are finely dispersed and the machinability is thus increased. The above oxide inclusions are hard, but as mentioned above, they coexist with MnS type sulfides and, therefore, the tool life will not be decreased but a stable chip separability-improving effect can be obtained. For securing such an effect, the content of Mg is preferably not less than 0.0005%. However, it is unfavorable from the cost viewpoint to cause such a low-boiling and readily evaporating element as Mg to be contained at levels exceeding 0.01%. Therefore, the content of Mg, when it is added, is recommendably not more than 0.01%.

REM (rare earth elements): not more than 0.01%

As mentioned above, REM includes a total of 17 elements, namely Sc, Y and lanthanoids. Industrially, lanthanoids are added in the form of a mischmetal. The content of REM, so referred to herein, means the total content of the above elements, as already mentioned.

REM is effective in further increasing the machinability of steel. For producing this effect, the content of REM is preferably not less than 0.0001% and, at levels not less than 0.001%, the effect can be more assuredly produced. Thus, REM has high affinity for O (oxygen) and S and influences on the activities of S and O at a content level of 0.0001% or more, and further forms inclusions containing REM oxy-sulfides and/or REM sulfides at 0.001% or more. In certain instances, eutectic MnS type sulfides are formed with the REM oxy-sulfides and/or REM sulfides as nucleation sites and the eutectic state is thus stabilized. However, when its content exceeds 0.01%, the proportion of sulfides containing REM oxy-sulfides and/or REM sulfides increases and the proportion of eutectic MnS type sulfides decreases, hence the machinability may decrease. Therefore, the content of REM, when it is added, is recommendably not more than 0.01%.

For improving such mechanical properties as tensile strength and toughness of the steel for machine structural use and further improving the machinability as defined above in (I) or (II), part of Fe may be replaced by one or more elements selected from among Ti: not more than 0.1%, Cr: not more than 2.5%, V: not more than 0.5%, Mo: not more than 1.0%, Nb: not more than 0.1%, Cu: not more than 1.0% and Ni: not more than 2.0% and one or more elements selected from among Se: not more than 0.01%, Te: not more than 0.01%, Bi: not more than 0.1%, Mg: not more than 0.01% and REM (rare earth elements): not more than 0.01%.

It is not necessary to particularly restrict the content of O (oxygen) as an impurity element in the steel for machine structural use according to the invention, since only the condition (A) or (B) mentioned below is required to be satisfied. However, although O is effective in preventing the wear of tools in machining, in particular in high speed cutting, an excessively high content of O may deteriorate the toughness of steels for machine structural use. Therefore, the content of O is desirably not more than 0.0125%, more desirably not more than 0.010%, still more desirably not more than 0.006%. No lower limit to the O content is placed. However, for more ensured morphological control of eutectic MnS type sulfides, the content of O is preferably not less than 0.0005%, more preferably not less than 0.002%.

The steel for machine structural use according to the present invention has the chemical composition already mentioned above and, in addition, is required to satisfy the condition (A) or (B) mentioned below.

(A): The effective Ca concentration index [Ca]e defined by the formula (1) given above is not more than 5 ppm.

(B): The proportion of MnO contained in oxide inclusions is not more than 0.05 and satisfies the relation represented by the formula (2) given above. Namely, the proportion of MnO contained in oxide inclusions is not more than 0.05 and the value of [Ca/O] is not more than 0.8.

Thus, the steel for machine structural use, as described above in (I), has the chemical composition mentioned above and, at the same time, is required to satisfy the above condition (A) so that eutectic MnS type sulfides may be formed and dispersed stably and reliably at an area percentage of not less than 40% as mentioned later. Thereby, the steel for machine structural use as described above in (I) acquires high chip separability.

On the other hand, the steel for machine structural use, as described above in (II), has the chemical composition mentioned above and, in addition, is required to satisfy the above condition (B) so that eutectic MnS type sulfides may be formed and dispersed stably and reliably at an area percentage of not less than 40% as mentioned later herein. Thereby, the steel for machine structural use as described above in (II) acquires high chip separability.

The steel for machine structural use, as described above in (I), can be given high chip separability more stably and more reliably when the Ca content therein is 0.0001 to 0.0048% and the content of O (oxygen) in impurities is 0.002 to 0.006%.

Similarly, the steel for machine structural use, as described above in (II), can be provided with high chip separability more stably and more reliably when the O (oxygen) content therein is 0.002 to 0.006%. In this case, the content of Ca is restricted at the same time by the formula (2).

First, the above condition (A) is explained.

In the formula (1) given above, T.[Ca] and T.[O] are the Ca content and O (oxygen) content in ppm by mass as determined by conventional methods of analysis, and $(O)_{ox}$ and $(Ca)_{ox}$ are the "proportion of O (oxygen) contained in oxide inclusions" and "proportion of Ca contained in oxide inclusions", respectively, as determined by an analytical apparatus such as an EDX (energy dispersive X-ray microanalyzer). As already mentioned, $(O)_{ox}$ and $(Ca)_{ox}$ respectively mean the "proportion of O (oxygen)" and "proportion of Ca" with the "mass of oxide inclusions being taken as 1".

The above $(O)_{ox}$ and $(Ca)_{ox}$ can be determined in the following manner.

That is, using the above-mentioned EDX, points in oxide inclusions observed or planes covering about ¼ of the inclusions are irradiated with an electron beam, and the concentrations of oxide-constituting elements contained in the inclusions are determined. They are converted to oxide compositions presumed based on stoichiometric oxides, and the proportion of O and the proportion of Ca in oxide inclusions are thus obtained.

While the composition of oxide inclusions varies to some extent, it is advisable that the average composition for about 10 to 30 oxide inclusions selected at random be employed and the proportion of O and proportion of Ca be calculated based on that average composition. For steels having a specific content of deoxidizing elements or steels produced by a specific steelmaking method, the empirical values of about 0.3 to 0.5 and about 0.01 to 0.4 may be used as $(O)_{ox}$ and $(Ca)_{ox}$, respectively.

In the following, the reason for the restriction of the effective Ca concentration index [Ca]e to 5 ppm or less is explained in detail.

Using an atmosphere-controllable high frequency induction furnace, the present inventors prepared 150-kg ingots of various steels having the contents of C, Si, Mn, S, P, Ca, N and Al of 0.39–0.41%, 0.17–0.23%, 0.6–0.7%, 0.045–0.055%, 0.015–0.025%, 0.0005–0.006%, 0.002–0.005% and 0.001–0.003%, respectively, and falling within the ranges specified herein. Thus, in a controlled atmosphere, each steel was melted in the conventional manner and, 1 to 2 minutes prior to casting, a CaSi ferroalloy was added for Ca treatment. On this occasion, the amount of addition of the CaSi ferroalloy was varied so that various effective Ca concentration index values [Ca]e could be obtained. The molten steel was then poured into a mold in the conventional manner and solidified.

Then, the steels prepared were heated to 1473 K and subjected to hot forging at a area reduction of about 93% and a finishing temperature of 1273 to 1373 K to give round bars with a diameter of 55 to 60 mm. The cooling after hot forging was allowed to proceed in the manner of atmospheric cooling.

The thus-obtained round bars were each examined for effective Ca concentration index [Ca]e, area percentage of eutectic MnS type sulfides and chip separability.

Thus, test specimens with a cross section parallel to the axis of forging (hereinafter, the cross section parallel to the direction of rolling or the axis of forging is referred to as "L section") serving as the test face were prepared from the above round bars with a diameter of 55 to 60 mm and, after mirror-like polishing, the $(O)_{ox}$ and $(Ca)_{ox}$ were determined for each specimen in the conventional manner using an EDX, as already mentioned. Then, the effective Ca concentration index [Ca]e was calculated from these values and the Ca content and O (oxygen) content, in ppm by mass, determined by the conventional methods of analysis, Further, each mirror-like polished L section was employed as the test face and observed for 12 fields under an optical microscope with a magnification of 200, and the area percentage of eutectic MnS type sulfides was determined. Following this, the mean of the area percentages of eutectic MnS type sulfides, as observed for 12 fields under an optical microscope with a magnification of 200, is referred to as "area percentage of eutectic MnS type sulfides". The area percentage of eutectic MnS type sulfides referred to herein is the value obtained by dividing the area of eutectic MnS type sulfides by the area of all sulfides. This value can be determined in a relatively easy manner by the conventional image processing. In the above observation, the total observation area is about 2.0 $mm^2$.

Eutectic MnS type sulfides mean colony-forming MnS type sulfides. Several to several tens of MnS type sulfides form a colony of about several tens to 300 $\mu$m in size and, therefore, they can be identified in a relatively easy manner from the state of dispersion.

The chip separability was evaluated by a turning test. Thus, in a dry lubrication system, turning was carried out using a tip for the carbide tool P20. The depth of the cut was 2.0 mm, the feed was 0.25 mm/rev, and the cutting speed was 132 m/min. The mass of the representative 10 chips was measured for chip separability evaluation.

Figure 2:
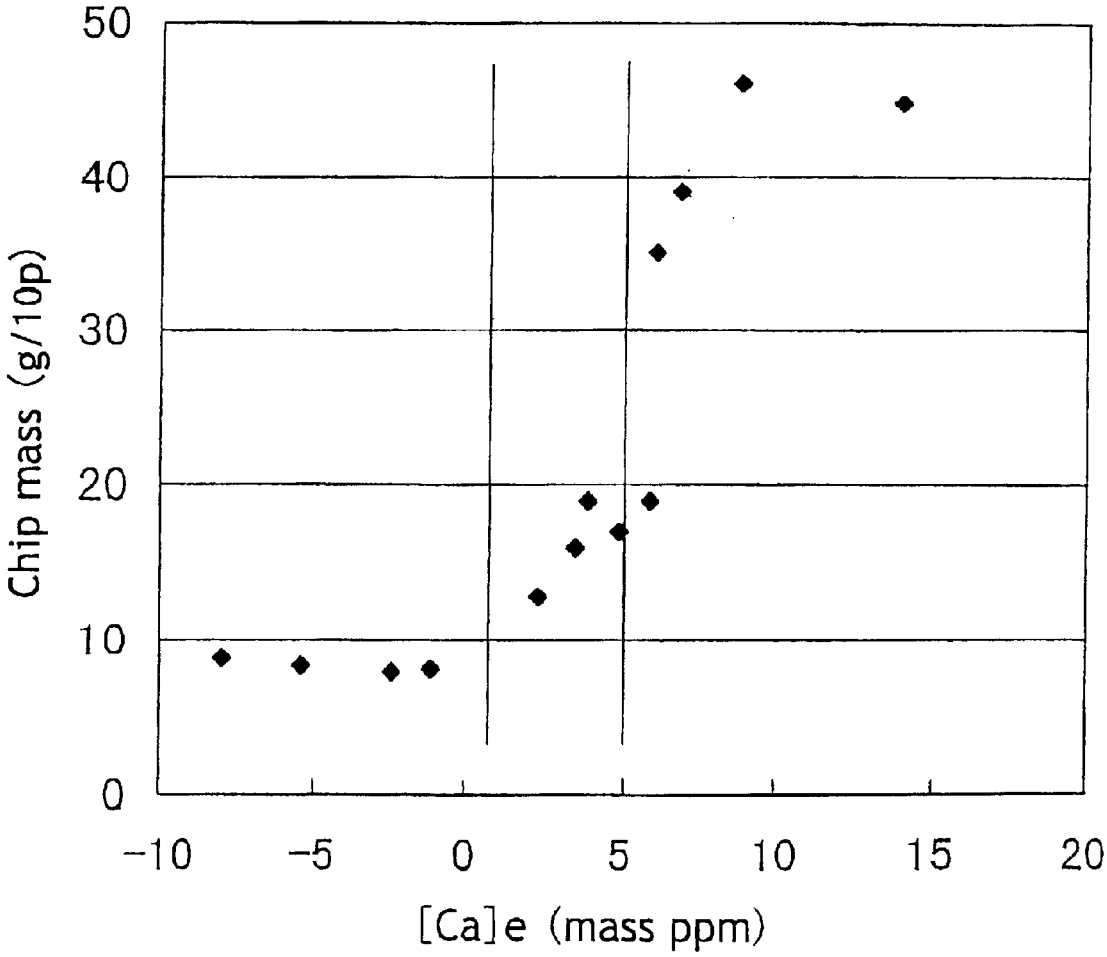
FIG. 2 is a graphic representation of the relationship between effective Ca concentration index [Ca]e and chip separability.

The results of the above various tests are shown in FIG. 1 and FIG. 2.

FIG. 1 is a graphic representation of the relationship between the effective Ca concentration index [Ca]e and the area percentage of eutectic MnS type sulfides, and FIG. 2 is a graphic representation of the relationship between the effective Ca concentration index [Ca]e and chip separability. In FIG. 2, the ordinate denotes the mass per 10 chips expressed as "g/10 p".

From FIG. 1, it is evident that when the effective Ca concentration index [Ca]e is not more than 5 ppm, the proportion of eutectic MnS type sulfides increases and the area percentage of eutectic MnS type sulfides stably and reliably becomes not less than 40%. Furthermore, from FIG. 2, it is also evident that the chip separability is stably and reliably improved and the mass of chips decreases when the effective Ca concentration index [Ca]e is not more than 5 ppm. Therefore, the effective Ca concentration index defined by the formula (1) given above should be not more than 5 ppm.

When the effective Ca concentration index [Ca]e is less than 1 ppm, an area percentage of eutectic MnS type sulfides of higher than 80% can be attained stably and reliably, as is evident from FIG. 1 and, further, the mass of chips is further reduced and the chip separability can be improved stably and reliably, as is evident form FIG. 2. Therefore, it is desirable that the effective Ca concentration index [Ca]e be not more than 1 ppm.

The condition (B) given above is now explained.

The symbols Ca and O in the formula (2) given above are the Ca content and O (oxygen) content determined by the conventional methods. The proportion of MnO contained in oxide inclusions means the "proportion of MnO" with the "mass of oxide inclusions being taken as 1" as determined by an analytical apparatus such as an EDX.

The above "proportion of MnO contained in oxide inclusions" can be determined in the same manner as the $(O)_{ox}$ and $(Ca)_{ox}$ in formula (1) already mentioned above, as follows.

That is, using an EDX, for instance, the points in oxide inclusions observed or planes covering about ¼ of the inclusions are irradiated with an electron beam, and the concentrations of oxide-constituting elements contained in the inclusions are determined. They are converted to oxide compositions, presumed based on stoichiometric oxides, and the proportion of the MnO contained in oxide inclusions is thus obtained. While the composition of oxide inclusions varies to some extent, it is advisable that the average composition for about 10 to 30 oxide inclusions, selected at random, be employed and the proportion of MnO be calculated based on that average composition.

In the following, the grounds for restricting the proportion of MnO contained in oxide inclusions to not more than 0.05 and restricting the value of Ca/O to not more than 0.8 are explained in detail.

The present inventors melted steels having respective compositions shown in Table 1 using a 3-ton atmospheric induction furnace. Thus, steel compositions derived from the basic composition of S48C, as described in JIS G 4051 by adding S, were melted and 3-ton steel ingots were produced.

Among the steels given in Table 1, the steels MC1 to MC3 are ordinary leaded free cutting steels. For the steels MA1 to MB10, the O (oxygen) content was adjusted by controlling the levels of addition of Al and Si and Mn and, a CaSi ferroalloy was added just prior to pouring each of the above steels into a mold and, by varying the level of addition thereof, the Ca content was adjusted.

TABLE 1

| Steel | Chemical composition (% by mass), balance: Fe and impurities | | | | | | | | | | |
|---|---|---|---|---|---|---|---|---|---|---|---|
| | C | Si | Mn | S | P | N | Al | Pb | Ca | O | Ca/O |
| MA1 | 0.48 | 0.23 | 0.81 | 0.049 | 0.017 | 0.0040 | 0.002 | — | 0.0015 | 0.0032 | 0.469 |
| MA2 | 0.47 | 0.22 | 0.81 | 0.048 | 0.018 | 0.0042 | 0.003 | — | 0.0031 | 0.0040 | 0.775 |
| MA3 | 0.48 | 0.25 | 0.82 | 0.051 | 0.017 | 0.0073 | 0.004 | — | 0.0020 | 0.0035 | 0.571 |
| MA4 | 0.46 | 0.23 | 0.78 | 0.050 | 0.016 | 0.0050 | 0.003 | — | 0.0021 | 0.0035 | 0.600 |
| MA5 | 0.47 | 0.20 | 0.79 | 0.049 | 0.015 | 0.0080 | 0.001 | — | 0.0030 | 0.0050 | 0.600 |
| MA6 | 0.48 | 0.18 | 0.82 | 0.048 | 0.017 | 0.0043 | 0.003 | — | 0.0015 | 0.0041 | 0.366 |
| MA7 | 0.46 | 0.23 | 0.83 | 0.050 | 0.018 | 0.0075 | 0.021 | — | 0.0008 | 0.0025 | 0.320 |
| MA8 | 0.49 | 0.28 | 0.84 | 0.049 | 0.015 | 0.0174 | 0.045 | — | 0.0007 | 0.0020 | 0.350 |
| MA9 | 0.47 | 0.21 | 0.80 | 0.051 | 0.016 | 0.0102 | 0.001 | — | 0.0051 | 0.0112 | 0.455 |
| MA10 | 0.49 | 0.25 | 0.79 | 0.052 | 0.017 | 0.0052 | 0.002 | — | 0.0032 | 0.0079 | 0.405 |
| MB1 | 0.48 | 0.24 | 0.81 | 0.048 | 0.016 | 0.0039 | 0.003 | — | 0.0027 | 0.0025 | 1.080 |
| MB2 | 0.47 | 0.25 | 0.82 | 0.049 | 0.018 | 0.0028 | 0.002 | — | 0.0014 | 0.0016 | 0.875 |
| MB3 | 0.48 | 0.24 | 0.84 | 0.050 | 0.022 | 0.0045 | 0.004 | — | 0.0040 | 0.0034 | 1.176 |
| MB4 | 0.49 | 0.21 | 0.80 | 0.049 | 0.019 | 0.0082 | 0.002 | — | 0.0015 | 0.0056 | 0.268 |
| MB5 | 0.50 | 0.23 | 0.81 | 0.051 | 0.017 | 0.0051 | 0.001 | — | 0.0027 | 0.0058 | 0.466 |
| MB6 | 0.48 | 0.22 | 0.81 | 0.048 | 0.015 | 0.0040 | 0.002 | — | 0.0025 | 0.0031 | 0.806 |
| MB7 | 0.47 | 0.17 | 0.78 | 0.051 | 0.016 | 0.0072 | 0.031 | — | 0.0029 | 0.0025 | 1.160 |
| MB8 | 0.48 | 0.18 | 0.79 | 0.049 | 0.017 | 0.0170 | 0.028 | — | 0.0041 | 0.0037 | 1.108 |
| MB9 | 0.46 | 0.16 | 0.75 | 0.054 | 0.015 | 0.0078 | 0.001 | — | 0.0042 | 0.0135 | 0.311 |
| MB10 | 0.45 | 0.19 | 0.82 | 0.048 | 0.019 | 0.0043 | 0.024 | — | 0.0010 | 0.0012 | 0.833 |
| MC1 | 0.48 | 0.25 | 0.81 | 0.048 | 0.015 | 0.0052 | 0.031 | 0.05 | — | 0.0020 | 0 |
| MC2 | 0.47 | 0.26 | 0.79 | 0.050 | 0.018 | 0.0170 | 0.027 | 0.14 | — | 0.0025 | 0 |
| MC3 | 0.47 | 0.24 | 0.80 | 0.057 | 0.019 | 0.0048 | 0.036 | 0.25 | — | 0.0019 | 0 |

Then, these steels were heated to 1523K and hot-rolled with a finishing temperature of 1273K, to give round bars with a diameter of 80 mm. In the above hot rolling, the area reduction was about 97%.

Then, the above round bars were heated to 1153K and normalized by maintaining at that temperature for 2 hours.

The thus-obtained round bars were examined for area percentage of eutectic MnS type sulfides, proportion of MnO contained in oxide inclusions, chip separability and tool life. The steels MC1 to MC3 are conventional leaded free cutting steels without addition of Ca. Therefore, the steels MC1 to MC3 were not examined for the area percentage of eutectic MnS type sulfides and the proportion of MnO contained in oxide inclusions.

Test specimens with the L section serving as the test face were prepared from the above round bars 80 mm in diameter and, after mirror-like polishing, the proportions of MnO contained in oxide inclusions were determined by the conventional method using an EDX, as already mentioned.

Further, each mirror-like polished L section was employed as the test face and observed for 12 fields under an optical microscope with a magnification of 200, and the area percentage of eutectic MnS type sulfides was determined. The area percentage of eutectic MnS type sulfides is the value obtained by dividing the area of eutectic MnS type sulfides by the area of all sulfides, as already mentioned above. This value can be determined in a relatively easy manner by the conventional image processing.

The chip separability was evaluated by a turning test. Thus, in a dry lubrication system, turning was carried out using a tip for the carbide tool P20. The depth of the cut was 2.0 mm, the feed was 0.25 mm/rev, and the cutting speed was 160 m/min. The mass of the representative 10 chips was measured for chip separability evaluation. The tool life was also examined when turning was carried out under the above conditions. Here, the tool life is defined as the time until the wear of the flank amounts to 0.2 mm.

The results of the above various tests are shown in Table 2.

TABLE 2

| Steel | Proportion of MnO contained in oxide inclusions | Area percentage (%) of eutectic MnS type sulfides | Chip mass (g/10 chips) | Tool life (minutes) |
|---|---|---|---|---|
| MA1 | 0.028 | 91 | 7.8 | 18.7 |
| MA2 | 0.005 | 89 | 8 | 21.0 |
| MA3 | 0.017 | 96 | 7.5 | 19.0 |
| MA4 | 0.013 | 98 | 7.3 | 18.6 |
| MA5 | 0.045 | 82 | 9.5 | 18.2 |
| MA6 | 0.038 | 89 | 8.1 | 22.0 |
| MA7 | 0.007 | 72 | 10.8 | 17.5 |
| MA8 | 0.005 | 65 | 12.7 | 15.8 |
| MA9 | 0.049 | 45 | 18.5 | 19.2 |
| MA10 | 0.045 | 55 | 15.8 | 18.3 |
| MB1 | 0.027 | 12 | 23.7 | 17.9 |
| MB2 | 0.014 | 31 | 21.8 | 19.5 |
| MB3 | 0.021 | 12 | 24.3 | 21.4 |
| MB4 | 0.065 | 38 | 20.5 | 15.3 |
| MB5 | 0.084 | 9 | 25.6 | 17.8 |
| MB6 | 0.057 | 3 | 36.3 | 18.3 |
| MB7 | 0.004 | 25 | 22.5 | 16.0 |
| MB8 | 0.009 | 18 | 21.9 | 17.5 |
| MB9 | 0.052 | 50 | 16.5 | 15.7 |
| MB10 | 0.008 | 43 | 17.8 | 16.5 |
| MC1 | Not measured | Not measured | 19.9 | 12.8 |
| MC2 | Not measured | Not measured | 12.5 | 14.5 |
| MC3 | Not measured | Not measured | 9.8 | 15.6 |

Figure 3:
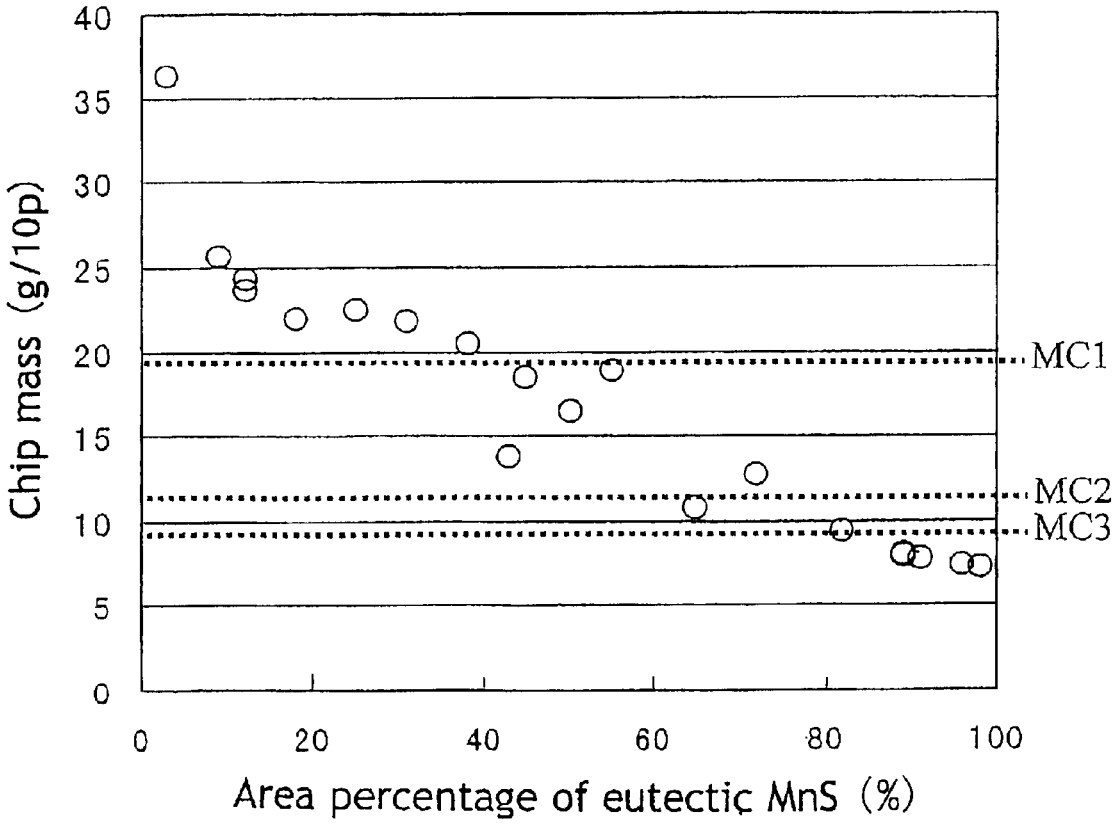
FIG. 3 is a graphic representation of the relationship between area percentage of eutectic MnS type sulfides and chip separability.

FIG. 3 is a graphic representation of the relationship between area percentage of eutectic MnS type sulfides and chip separability for the steels MA1 to MA10 in Table 1. In this FIG. 3, the lines showing the chip masses for the steels MC1 to MC3 are drawn for comparison. In FIG. 3, the ordinate denotes the mass per 10 chips, expressed as "g/10 p". As already mentioned, the area percentage of eutectic MnS type sulfides along the abscissa denotes the mean of area percentages of the eutectic MnS type sulfides observed in 12 fields under an optical microscope with a magnification of 200.

From FIG. 3, it is seen that the chip separability improves with the increase in area percentage of eutectic MnS type sulfides. From this FIG. 3 and Table 2, it is evident that when the area percentage of eutectic MnS type sulfides is not less than 40%, the chip separability attainable is comparable to that of the free cutting steel containing 0.05% of Pb (steel MC1) and, when the area percentage of eutectic MnS type sulfides is not less than 80%, the chip separability obtainable is comparable to that of the free cutting steels containing 0.14 to 0.25% of Pb (steel MC2 and steel MC3).

Figure 4:
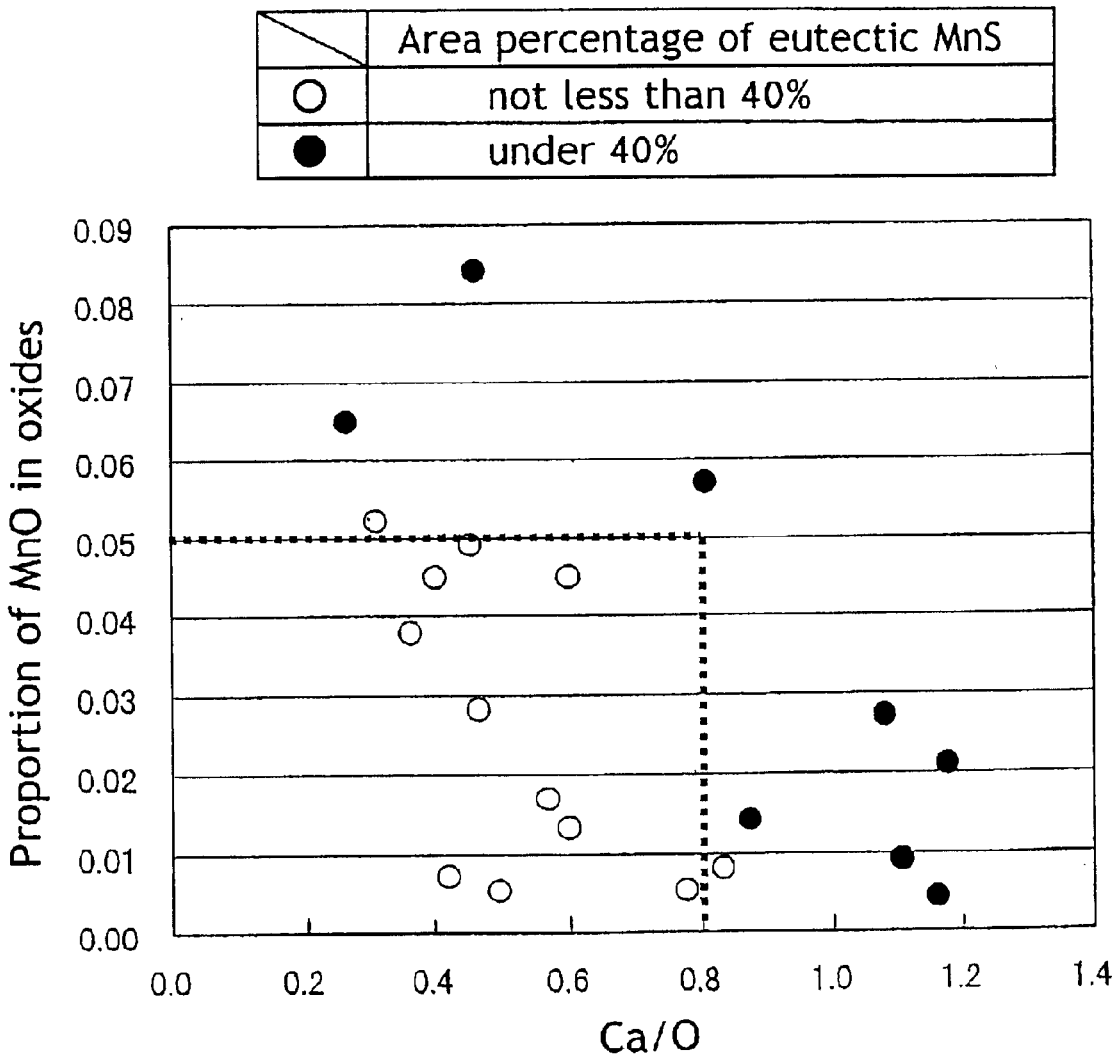
FIG. 4 is a graphic representation of the effects of the proportion of MnO contained in oxide inclusions and the value of Ca/O on the area percentage of eutectic MnS type sulfides.

FIG. 4 is a graphic representation of the effects of the proportion of MnO contained in oxide inclusions and the value of Ca/O on the area percentage of eutectic MnS type sulfides for the steels excluding the leaded free cutting steels MC1 to MC3 in Table 1. In this FIG. 4, the ordinate denotes the "proportion of MnO in oxides", and area percentages of eutectic MnS type sulfides of 40% or more are indicated by the mark "○" and area percentages less 40% by "●".

From FIG. 4, it is seen that when the Ca/O value is not more than 0.8 and the proportion of MnO in oxide inclusions is not more than 0.05, the area percentage of eutectic MnS type sulfides stably and reliably becomes 40% or more.

When the Ca/O value exceeds 0.8, Ca begins to dissolve in sulfides and, as a result, CaS and the like sulfides containing Ca as a solute are readily formed. The Ca-containing sulfides crystallize at a higher temperature as compared with eutectic MnS type sulfides and form dot-like isolated sulfides irrelevant to the solidification structure of blooms, thus presumably decreasing the area percentage of eutectic MnS type sulfides.

When the proportion of MnO contained in oxide inclusions exceeds 0.05, sulfides rich in MnO are formed and these sulfides, too, crystallize at a higher temperature as compared with eutectic MnS type sulfides and form dot-like isolated sulfides irrelevant to the solidification structure of blooms, like the Ca-containing sulfide mentioned above. Presumably, a reduction in area percentage of eutectic MnS type sulfides is thus induced.

Figure 5:
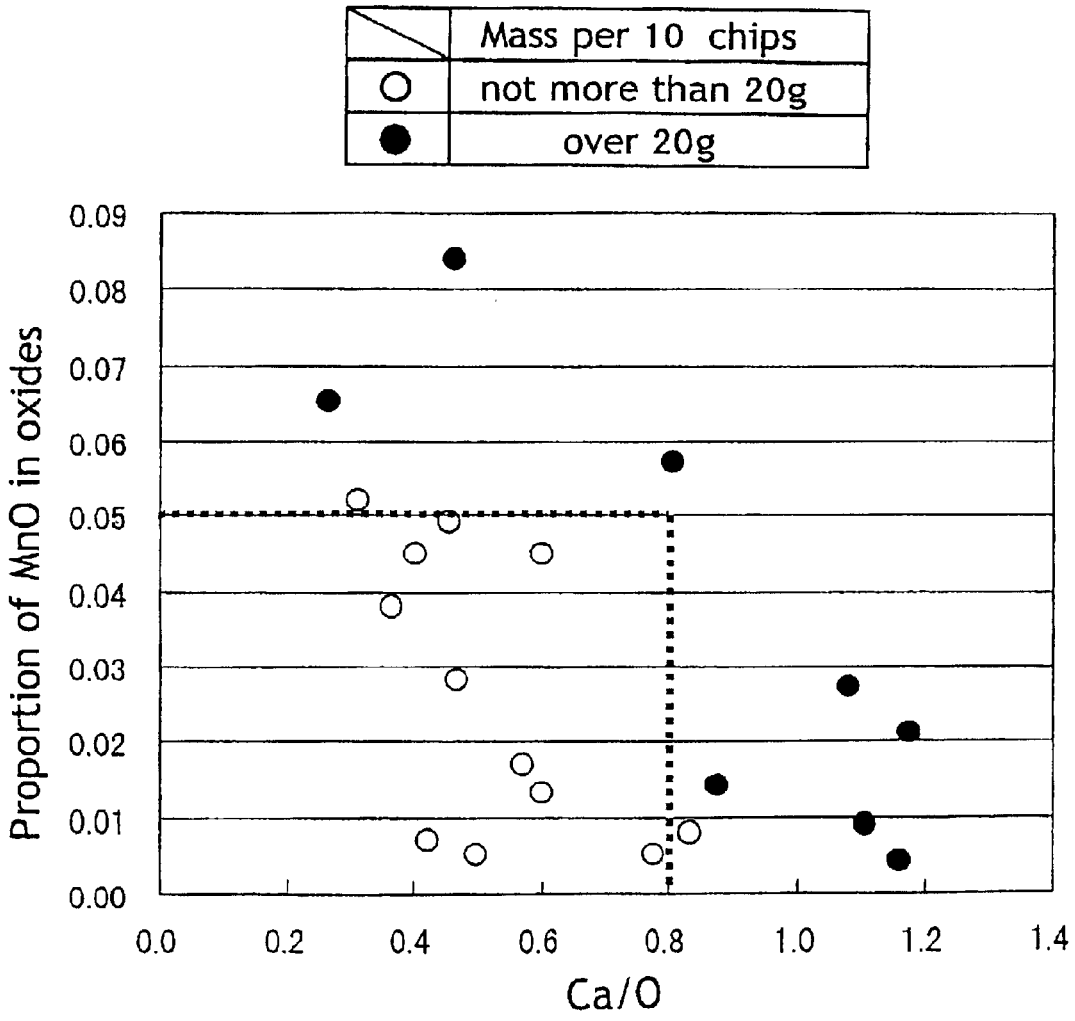
FIG. 5 is a graphic representation of the effects of the proportion of MnO contained in oxide inclusions and the value of Ca/O on the chip separability.

FIG. 5 summarizes the results shown in FIG. 3 and FIG. 4, excluding the results for the leaded free cutting steels MC1 to MC3 and is a graphic representation of the effects of the proportion of MnO contained in oxide inclusions and the value of Ca/O on the chip separability. In this FIG. 5, the results satisfying the condition that the mass per 10 chips should amount to not more than 20 g are shown by the mark "○" and the results showing a mass per 10 chips of more than 20 g by "●".

The above FIG. 5 indicates that when the conditions that the Ca/O value should be not more than 0.8 and the proportion of MnO contained in oxide inclusions should be not more than 0.05 are satisfied, the area percentage of eutectic MnS type sulfides stably and reliably becomes 40% or more and, as a result, the desired chip separability can be obtained, namely the requirement that the mass per representative 10 chips should be not more than 20 g can be satisfied.

In view of the foregoing, the value of Ca/O should be not more than 0.8 and the proportion of MnO contained in oxide inclusion should be not more than 0.05 in the practice of the present invention.

Further, as is evident from Table 2, the tool lives were not shorter than 15 minutes, hence attained the goal, with all the steels MA1 to MB10 having the respective chemical compositions shown in Table 1.

As already mentioned, the steel for machine structural use as described above in (I), when it has the above-mentioned chemical composition and satisfies the above condition (A), can stably and reliably form and disperse eutectic MnS type sulfides in an amount of not less than 40%, as expressed in terms of area percentage, and thus can acquire high chip separability.

The steel for machine structural use, as described above in (II), when it has the above-mentioned chemical composition and satisfied the above-mentioned condition (B), stably and reliably has an area percentage of eutectic MnS type sulfides of not less than 40% and thus can show high chip separability.

Now, the "method of producing steels for machine structural use" as defined above under (III) is explained.

According to the method of producing steels for machine structural use as mentioned above under (III), calcium is added to a molten steel having a chemical composition, as defined above under (I), but containing no calcium while stirring the molten steel under conditions such that the stirring energy $\epsilon$, defined by the formula (3) given above, amounts to not more than 60 W/t and under conditions such that the value of A defined by the formula (4) given above, amounts to not more than 20 and the resulting molten steel is subjected to continuous casting.

The method of producing steels for machine structural use, as mentioned above under (III), has been obtained based on the results of the experiments shown below, made by the present inventors to grasp the relationship between stirring energy $\epsilon$ per ton of molten steel and O (oxygen) content and the relationship between the value of A defined by the formula (4), given above, and the effective Ca concentration index [Ca]e defined by the formula (1). It is a preferred embodiment by which the steel for machine structural use, as mentioned above under (I), can be produced in a relatively easy manner even when large-sized equipment is used.

Thus, the present inventors made experiments in which 80 to 400 g, calculated as pure Ca, per ton of molten steel, of a CaSi ferroalloy was added to 70 to 72 tons each of molten steels having C, Si, Mn, S, P, N and Al contents of 0.35–0.55%, 0.15–0.20%, 0.6–0.8%, 0.04–0.06%, 0.015–0.02%, 0.012–0.020% and 0.001–0.005%, respectively, while stirring each molten steel by means of Ar gas fed from a porous plug provided at the bottom of a ladle.

In the above experiments, the molten steel temperature was within the range of 1823 to 1923K, the Ar gas stirring time was within the range of 1200 to 3600 seconds, and calcium treatment was carried out by adding the CaSi ferroalloy within about 600 seconds in the last stage of stirring.

Figure 6:
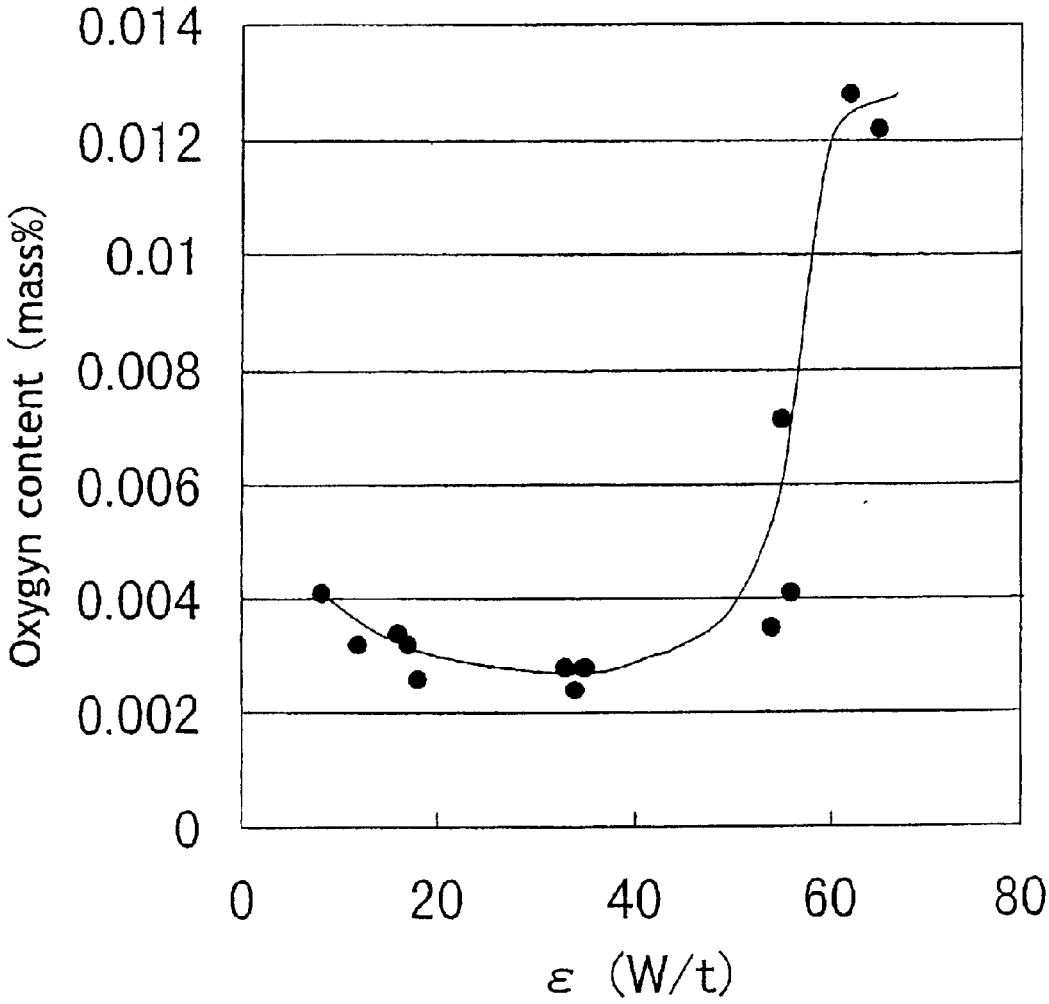
FIG. 6 is a graphic representation of the relationship between molten steel stirring energy $\epsilon$ per ton of molten steel and total O (oxygen) content in molten steel.

FIG. 6 is a graphic representation of the relationship between the above-mentioned stirring energy $\epsilon$ and the O (oxygen) content.

From this FIG. 6, it was found that when the stirring energy $\epsilon$, defined by the formula (3) exceeds 60 W/t, the O (oxygen) content exceeds 0.0125% and the index of cleanliness of steel, which is required of steels for machine structural use, cannot be attained in certain instances. Therefore, the stirring energy $\epsilon$ defined by the formula (3) should be not more than 60 W/t. When the stirring energy $\epsilon$ defined by the formula (3) is not more than 55 W/t, the O content can be stably and reliably reduced to 0.006% or less.

Figure 7:
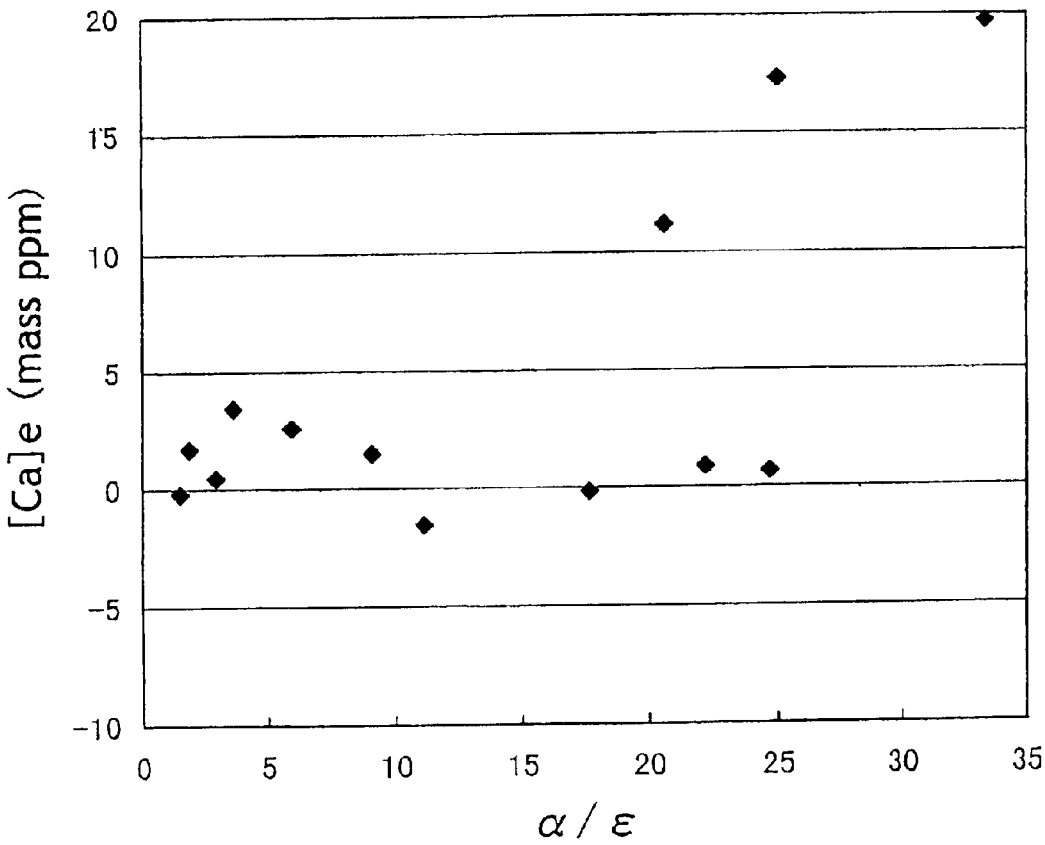
FIG. 7 is a graphic representation of the relationship between value of A defined by formula (4) and effective Ca concentration index [Ca]e defined by formula (1) as revealed when a CaSi ferroalloy was added under conditions such that the stirring energy $\epsilon$ defined by formula (3) amounted to not more than 60 W/t.

FIG. 7 is a graphic representation of the relationship between value of A, defined by formula (4), and the effective Ca concentration index [Ca]e, defined by formula (1), as revealed when the CaSi ferroalloy was added under conditions such that the above-mentioned stirring energy $\epsilon$ amounted to not more than 60 W/t. In these experiments, each molten steel in the tundish was sampled by means of the so-called "iron bomb" for chemical composition analysis, and the sample in the bomb was observed and analyzed for oxide inclusions, using the above-mentioned EDX, and the proportions of O (oxygen) and Ca contained in the oxide inclusions, namely $(O)_{ox}$ and $(Ca)_{ox}$, were determined and the effective Ca concentration index [Ca]e was calculated, according to the formula (1) given above.

From this FIG. 7, it can be seen that when the value of A defined by formula (4) is not more than 20, the effective Ca concentration index [Ca]e can be stably and reliably reduced to 5 ppm or less. Therefore, the value of A defined by formula (4) should be not more than 20.

The above-mentioned steel (I) for machine structural use can be produced in a relatively easy manner by the method of producing steels for machine structural use as mentioned above under (III) even when large-sized equipment is used.

The above-mentioned steel (II) for machine structural use can be produced, for example, by satisfying the following two conditions in deoxidation control, utilizing the so-called "slag-metal reaction" in the ladle refining step following tapping from the steelmaking furnace, as shown below.

One condition is concerned with deoxidation control in a step prior to Ca treatment by adding a CaSi ferroalloy or the like in the last state of refining in ladle. Thus, the value of Ca/O can be stably reduced to 0.8 or less by adjusting the Ca content within the specified range, by adding the above-mentioned CaSi ferroalloy in a refined state in which the steel contains the deoxidizing elements Si and Mn and, optionally, Al, the total content of Fe and MnO in the ladle slag is not more than 5% and the O (oxygen) content in steel is not more than 0.0125%, preferably not more than 0.010%, more preferably not more than 0.006%.

The other condition is a matter of particular concern when a large-sized steelmaking furnace is used and is concerned with deoxidation control after tapping of the steel from the steelmaking furnace. Thus, after tapping from the steelmaking furnace, the O (oxygen) content in steel in the initial stage of ladle refining is adjusted to not more than 0.0125%, preferably not more than 0.010%, more preferably not more than 0.006%, by adjusting the level of addition of such deoxidizing agents as Si, Mn and Al. Thereby, the proportion of MnO in oxide inclusions can be reduced from the initial stage of ladle refining and, thus, the proportion of MnO in oxide inclusions can be stably reduced to 0.05 or less.

Summarizing the foregoing, typical embodiments of the present invention concerning steels for machine structural use and a method of producing the same are shown in the following examples (1) to (11).

(1) A steel for machine structural use which comprises, on the percent by mass basis, C: 0.1 to 0.6%, Si: 0.01 to 2.0%, Mn: 0.2 to 2.0%, S: 0.005 to 0.20%, P: not more than 0.1%, Ca: 0.0001 to 0.01%, N: 0.001 to 0.02% and Al: not more than 0.1%, with the balance being Fe and impurities, the effective Ca concentration index defined by the formula (1) given above being not more than 5 ppm by mass.

(2) A steel for machine structural use as described above under (1), which contains one or more elements selected from among Ti: not more than 0.1%, Cr: not more than 2.5%, V: not more than 0.5%, Mo: not more than 1.0%, Nb: not more than 0.1%, Cu: not more than 1.0% and Ni: not more than 2.0% in lieu of part of Fe.

(3) A steel for machine structural use as described above under (1), which contains one or more elements selected from among Se: not more than 0.01%, Te: not more than 0.01%, Bi: not more than 0.1%, Mg: not more than 0.01% and REM (rare earth elements): not more than 0.01% in lieu of part of Fe.

(4) A steel for machine structural use as described above under (1), which contains one or more elements selected from among Ti: not more than 0.1%, Cr: not more than 2.5%, V: not more than 0.5%, Mo: not more than 1.0%, Nb: not more than 0.1%, Cu: not more than 1.0% and Ni: not more than 2.0% and one or more elements selected from among Se: not more than 0.01%, Te: not more than 0.01%, Bi: not more than 0.1%, Mg: not more than 0.01% and REM (rare earth elements): not more than 0.01% in lieu of part of Fe.

(5) A steel for machine structural use which comprises, on the percent by mass basis, C: 0.1 to 0.6%, Si: 0.01 to 2.0%, Mn: 0.2 to 2.0%, S: 0.005 to 0.20%, P: not more than 0.1%, Ca: 0.0001 to 0.01%, N: 0.001 to 0.02% and Al: not more than 0.1%, with the balance being Fe and impurities, the proportion of MnO contained in oxide inclusions being not more than 0.05 and the relation of the formula (2) given above being satisfied.

(6) A steel for machine structural use as described above under (5), which contains one or more elements selected from among Ti: not more than 0.1%, Cr: not more than 2.5%, V: not more than 0.5%, Mo: not more than 1.0%, Nb: not more than 0.1%, Cu: not more than 1.0% and Ni: not more than 2.0% in lieu of part of Fe.

(7) A steel for machine structural use as described above under (5), which contains one or more elements selected from among Se: not more than 0.01%, Te: not more than 0.01%, Bi: not more than 0.1%, Mg: not more than 0.01% and REM (rare earth elements): not more than 0.01% in lieu of part of Fe.

(8) A steel for machine structural use as described above under (5), which contains one or more elements selected from among Ti: not more than 0.1%, Cr: not more than 2.5%, V: not more than 0.5%, Mo: not more than 1.0%, Nb: not more than 0.1%, Cu: not more than 1.0% and Ni: not more than 2.0% and one or more elements selected from among Se: not more than 0.01%, Te: not more than 0.01%, Bi: not more than 0.1%, Mg: not more than 0.01% and REM (rare earth elements): not more than 0.01% in lieu of part of Fe.

(9) A steel for machine structural use as described above under any of (1) to (4) in which the Ca content is 0.0001 to 0.0048% and the content of O (oxygen) in impurities is 0.002 to 0.006%.

(10) A steel for machine structural use as described above under any of (5) to (8) in which the content of O (oxygen) in impurities is 0.002 to 0.006%.

(11) A method of producing the steel for machine structural use described above under any of (1) to (4) which comprises adding calcium to a molten steel, having a chemical composition as described above in any of (1) to (4), but containing no calcium while stirring the molten steel under conditions such that the stirring energy defined by the formula (3) given above amounts to not more than 60 W/t and under conditions such that the value of A defined by the formula (4) given above amounts to not more than 20.

EXAMPLES

The following examples illustrate the present invention more concretely. These examples are, however, by no means limitative of the scope of the present invention.

Example 1

Using an atmosphere-controllable high frequency induction furnace, 150-kg steel ingots, having the chemical compositions shown in Table 3, were produced. Thus, in an inert gas atmosphere, steels were melted at a temperature of 1823–1873K and, after adjustment of alloying components, iron oxide and CaSi ferroalloy wires were added and, at the same time, stirring was carried out by means of Ar gas. After adjustment of the O (oxygen) content and Ca content, the molten steels were each poured into a mold and solidified. Round ingots about 220 mm in diameter were thus produced.

Each of the steel ingots was heated to 1473K and subjected to hot forging. The finishing temperature was 1273K. Round bars 57 mm in diameter were thus produced. The cooling after hot forging was carried out in the manner of atmospheric cooling.

TABLE 3

| Steel | Chemical composition (% by mass), balance: Fe and impurities | | | | | | | | | | | | | |
|---|---|---|---|---|---|---|---|---|---|---|---|---|---|---|
| | C | Si | Mn | S | P | N | Al | Cr | V | Ti | Ca | O | Other(s) | Ca/O |
| A1 | 0.45 | 0.20 | 0.90 | 0.095 | 0.020 | 0.004 | 0.002 | — | — | — | 0.0012 | 0.0023 | — | 0.52 |
| A2 | 0.46 | 0.21 | 0.85 | 0.092 | 0.018 | 0.004 | 0.002 | 0.15 | 0.08 | — | 0.0013 | 0.0031 | — | 0.42 |
| A3 | 0.44 | 0.22 | 0.95 | 0.088 | 0.019 | 0.004 | 0.002 | 0.15 | 0.08 | 0.008 | 0.0021 | 0.0028 | — | 0.75 |
| A4 | 0.45 | 0.21 | 0.89 | 0.091 | 0.017 | 0.004 | 0.0005 | 0.15 | 0.08 | 0.005 | 0.0051 | 0.0064 | — | 0.80 |
| A5 | 0.45 | 0.20 | 0.98 | 0.097 | 0.020 | 0.004 | 0.002 | 0.15 | 0.08 | 0.007 | 0.0023 | 0.0021 | — | 1.10 |
| A6 | 0.46 | 0.20 | 0.88 | 0.098 | 0.020 | 0.004 | 0.002 | 0.15 | 0.08 | 0.008 | 0.0032 | 0.0023 | — | 1.39 |
| A7 | 0.44 | 0.51 | 0.98 | 0.088 | 0.019 | 0.004 | 0.002 | 0.15 | 0.08 | 0.008 | 0.0017 | 0.0025 | — | 0.68 |
| A8 | 0.44 | 0.22 | 0.92 | 0.096 | 0.020 | 0.003 | 0.021 | 0.15 | 0.08 | 0.008 | 0.0007 | 0.0025 | — | 0.28 |
| A9 | 0.45 | 0.21 | 0.91 | 0.095 | 0.021 | 0.005 | 0.021 | 0.15 | 0.08 | 0.010 | 0.0008 | 0.0019 | — | 0.42 |
| A10 | 0.45 | 0.22 | 0.92 | 0.097 | 0.020 | 0.004 | 0.038 | 0.14 | 0.08 | 0.009 | 0.0003 | 0.0004 | — | 0.75 |
| A11 | 0.45 | 0.21 | 0.90 | 0.096 | 0.019 | 0.004 | 0.023 | 0.14 | 0.08 | 0.009 | 0.0009 | 0.0011 | — | 0.82 |
| A12 | 0.45 | 0.23 | 0.93 | 0.098 | 0.020 | 0.003 | 0.034 | 0.15 | 0.08 | 0.008 | 0.0021 | 0.0018 | — | 1.17 |
| B1 | 0.39 | 0.45 | 1.20 | 0.178 | 0.018 | 0.004 | 0.002 | 0.08 | 0.10 | — | 0.0018 | 0.0026 | Mg: 0.0002 | 0.69 |
| B2 | 0.40 | 0.42 | 1.22 | 0.180 | 0.021 | 0.004 | 0.002 | 0.07 | 0.11 | — | 0.0009 | 0.0021 | | 0.43 |
| B3 | 0.41 | 0.41 | 1.18 | 0.170 | 0.020 | 0.003 | 0.002 | 0.08 | 0.10 | — | 0.0023 | 0.0023 | Mg: 0.0003 | 1.00 |
| B4 | 0.40 | 0.42 | 1.21 | 0.170 | 0.020 | 0.003 | 0.002 | 0.07 | 0.10 | — | 0.0030 | 0.0025 | — | 1.20 |
| H1 | 0.38 | 0.25 | 0.71 | 0.048 | 0.015 | 0.018 | 0.002 | 0.06 | — | 0.008 | 0.0017 | 0.0034 | — | 0.50 |
| H2 | 0.39 | 0.24 | 0.71 | 0.051 | 0.015 | 0.017 | 0.001 | 0.05 | — | 0.007 | 0.0021 | 0.0026 | — | 0.81 |
| H3 | 0.39 | 0.26 | 0.69 | 0.052 | 0.014 | 0.016 | 0.002 | 0.05 | — | 0.010 | 0.0017 | 0.0025 | — | 0.68 |
| H4 | 0.40 | 0.25 | 0.70 | 0.049 | 0.016 | 0.017 | 0.002 | 0.05 | — | 0.006 | 0.0023 | 0.0021 | — | 1.10 |
| H5 | 0.41 | 0.26 | 0.71 | 0.050 | 0.015 | 0.017 | 0.002 | 0.05 | — | 0.008 | 0.0032 | 0.0023 | — | 1.39 |
| H6 | 0.40 | 0.25 | 0.72 | 0.049 | 0.015 | 0.016 | 0.002 | 0.05 | — | 0.008 | 0.0013 | 0.0031 | Se: 0.02, La 0.003 | 0.42 |
| H7 | 0.41 | 0.25 | 0.71 | 0.048 | 0.016 | 0.016 | 0.002 | 0.05 | — | 0.008 | 0.0021 | 0.0028 | Se: 0.02, La 0.003 | 0.75 |
| H8 | 0.40 | 0.26 | 0.71 | 0.049 | 0.015 | 0.017 | 0.002 | 0.05 | — | 0.008 | 0.0023 | 0.0021 | Se: 0.02, La 0.003 | 1.10 |
| CM1 | 0.19 | 0.25 | 0.72 | 0.017 | 0.018 | 0.004 | 0.018 | 1.05 | 0.20 | — | 0.0019 | 0.0042 | — | 0.45 |
| CM2 | 0.20 | 0.24 | 0.71 | 0.018 | 0.019 | 0.004 | 0.023 | 1.04 | 0.19 | — | 0.0007 | 0.0028 | — | 0.25 |
| CM3 | 0.19 | 0.26 | 0.73 | 0.016 | 0.018 | 0.003 | 0.027 | 1.06 | 0.18 | — | 0.0017 | 0.0017 | — | 1.00 |

The thus-obtained round bar of each steel was examined for effective Ca concentration index [Ca]e and chip separability.

Thus, test specimens with the L cross section serving as the test face were prepared from each round bar 57 mm in diameter and, after mirror-like polishing, the $(O)_{ox}$ and $(Ca)_{ox}$ were determined by the conventional method using an EDX, as already mentioned above. Then, the effective Ca concentration index [Ca]e was calculated from these values and the Ca content in ppm by mass and the O (oxygen) content in ppm by mass.

The chip separability was evaluated by turning and by drilling.

The turning test was carried out using a tip for the carbide tool P20 in a dry lubrication system at a depth of a cut of 2.0 mm, a feed of 0.25 mm/rev, and a cutting speed of 132 m/min, and the mass per 10 representative chips was measured for chip separability evaluation.

The drilling test was carried out using an ordinary high speed steel drill 5 mm in diameter, together with the water-soluble cutting fluid (emulsion type) W1 specified in JIS K 2241 as a lubricant, and holes 50 mm in depth were drilled at a feed of 0.15 mm/rev and a cutting speed of 18.5 m/min. The mass per representative 100 chips was measured for chip separability evaluation.

Figure 8:
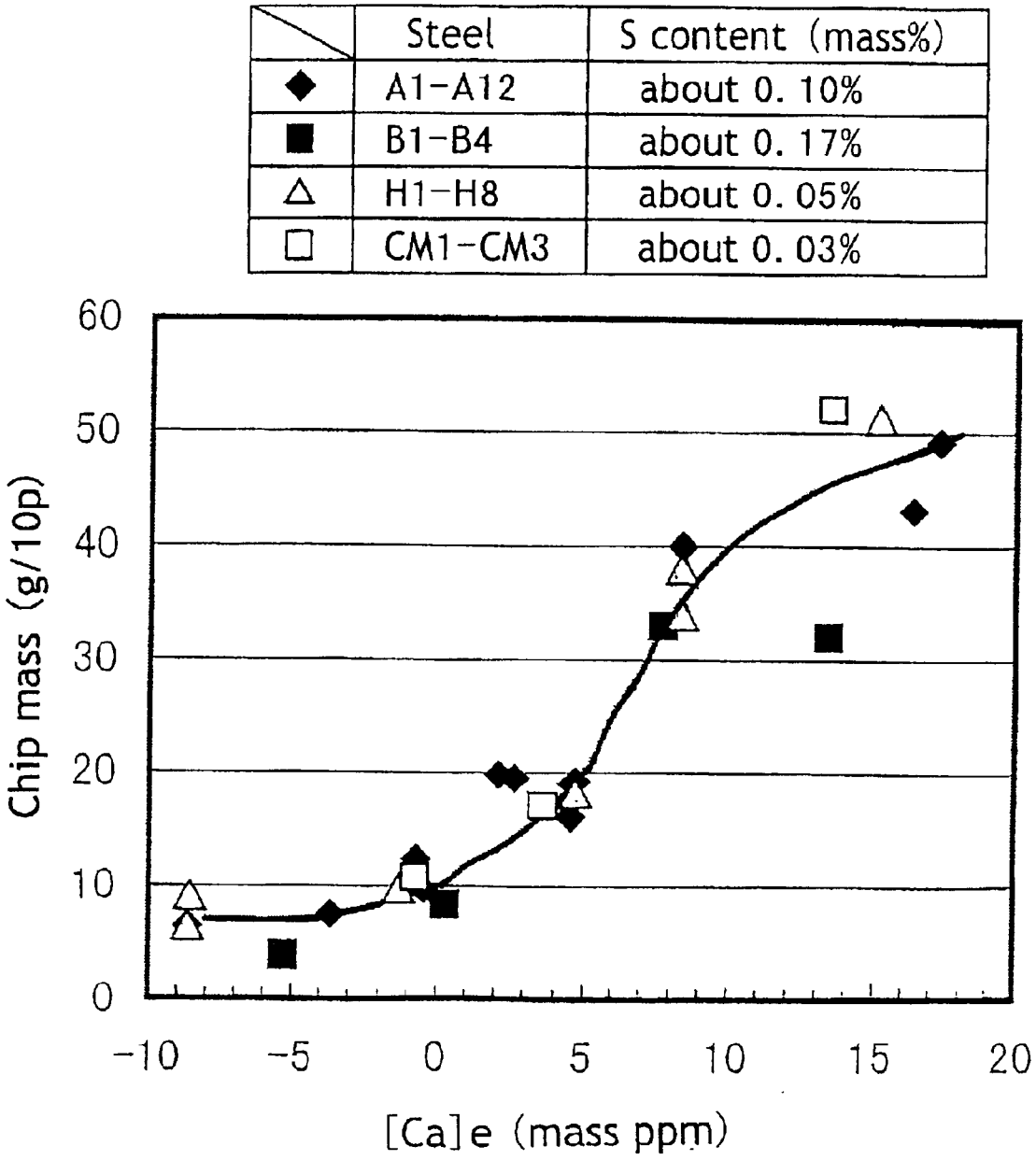
FIG. 8 is a graphic representation of the relationship between effective Ca concentration index [Ca]e and chip separability in turning.
Figure 9:
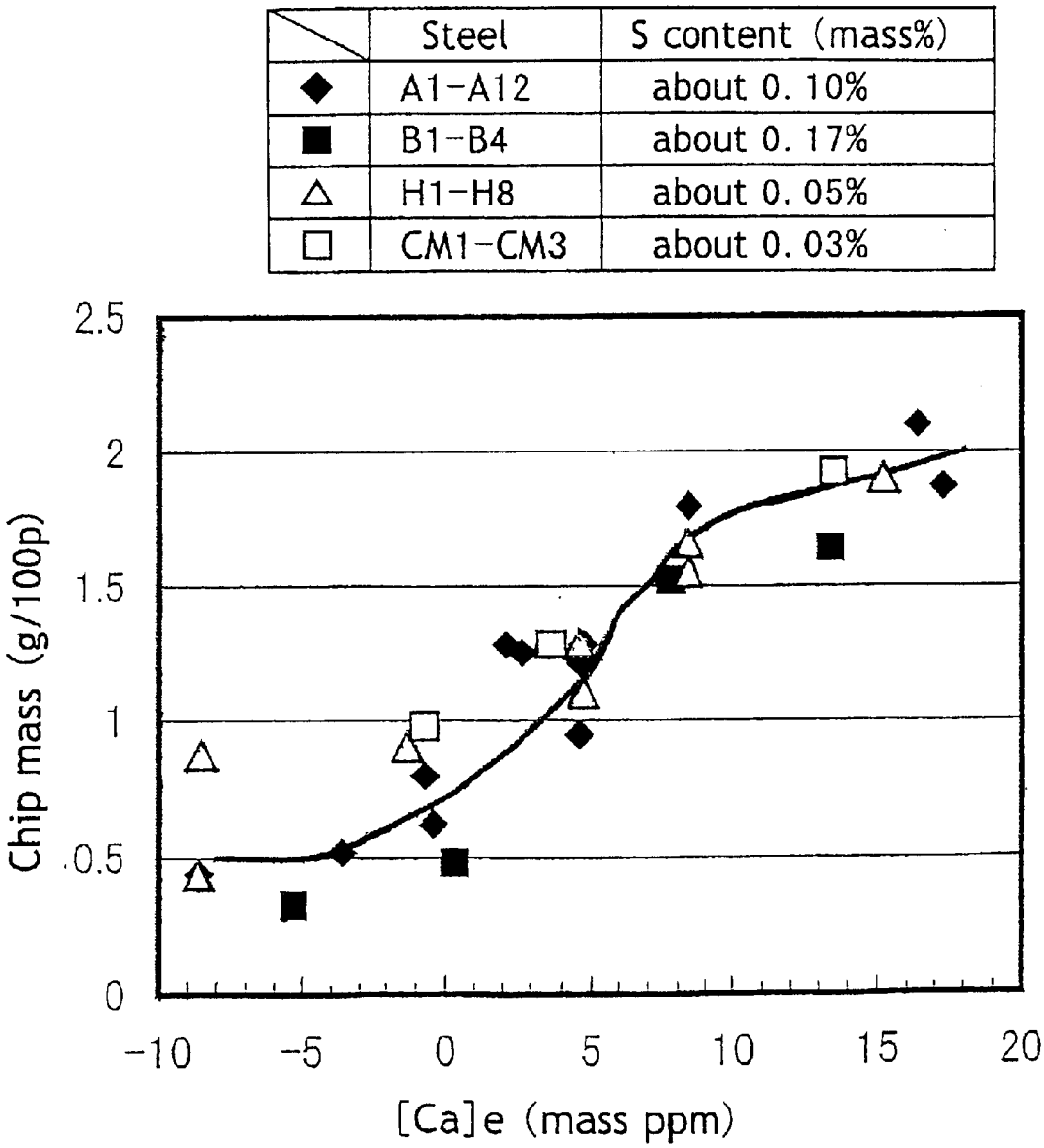
FIG. 9 is a graphic representation of the relationship between effective Ca concentration index [Ca]e and chip separability in drilling.

The results of the above various tests are shown in Table 4, FIG. 8 and FIG. 9.

TABLE 4

| Steel | Proportion of Ca or O contained in oxide inclusions | | [Ca]e | Chip mass in turning | Chip mass in drilling (g/100 |
|---|---|---|---|---|---|
| | $(Ca)_{ox}$ | $(O)_{ox}$ | (ppm) | (g/10 chips) | chips) |
| A1 | 0.286 | 0.42 | −3.6 | 7.5 | 0.52 |
| A2 | 0.293 | 0.42 | −8.6 | 6.4 | 0.44 |
| A3 | 0.264 | 0.45 | 4.6 | 16.0 | 0.95 |
| A4 | 0.329 | 0.43 | 2.1 | 19.8 | 1.28 |
| A5 | 0.286 | 0.41 | 8.4 | 40.0 | 1.80 |
| A6 | 0.286 | 0.42 | 16.4 | 43.1 | 2.10 |
| A7 | 0.293 | 0.42 | −0.4 | 9.7 | 0.62 |
| A8 | 0.136 | 0.44 | −0.7 | 12.4 | 0.80 |
| A9 | 0.079 | 0.44 | 4.6 | 19.0 | 1.21 |
| A10 | 0.036 | 0.44 | 2.7 | 19.5 | 1.25 |
| A11 | 0.171 | 0.44 | 4.7 | 19.2 | 1.28 |
| A12 | 0.093 | 0.45 | 17.3 | 49.2 | 1.87 |
| B1 | 0.293 | 0.43 | 0.3 | 8.3 | 0.48 |
| B2 | 0.293 | 0.43 | −5.3 | 3.8 | 0.33 |
| B3 | 0.279 | 0.42 | 7.7 | 33.0 | 1.52 |
| B4 | 0.286 | 0.43 | 13.4 | 32.0 | 1.64 |
| H1 | 0.293 | 0.39 | −8.5 | 9.1 | 0.88 |
| H2 | 0.271 | 0.43 | 4.6 | 18.1 | 1.28 |
| H3 | 0.300 | 0.41 | −1.3 | 9.8 | 0.91 |
| H4 | 0.293 | 0.42 | 8.4 | 38.0 | 1.66 |
| H5 | 0.307 | 0.42 | 15.2 | 51.3 | 1.90 |
| H6 | 0.293 | 0.42 | −8.6 | 6.4 | 0.44 |
| H7 | 0.250 | 0.43 | 4.7 | 18.2 | 1.10 |
| H8 | 0.286 | 0.41 | 8.4 | 34.0 | 1.55 |
| CM1 | 0.150 | 0.41 | 3.6 | 17.0 | 1.28 |
| CM2 | 0.121 | 0.44 | −0.7 | 10.7 | 0.98 |
| CM3 | 0.093 | 0.45 | 13.5 | 52.1 | 1.92 |

FIG. 8 is a graphic representation of the relationship between effective Ca concentration index [Ca]e and chip separability in turning. In FIG. 8, the ordinate denotes the mass per 10 chips, expressed as "g/10 p".

From FIG. 8, it is evident that, in working steels with various S content levels by turning, the mass per 10 typical chips can be stably and reliably reduced to 20 g or less when the effective Ca concentration index [Ca]e is reduced to 5 ppm or less. It is also evident that when the effective Ca concentration index [Ca]e is reduced to 1 ppm or less, the mass per 10 chips can be reduced to about 10 g, indicating a still better chip separability.

FIG. 9 is a graphic representation of the relationship between the effective Ca concentration index [Ca]e and chip separability in drilling. In FIG. 9, the ordinate denotes the mass per 100 chips, expressed as "g/100 p".

From FIG. 9, it is evident that good chip separability can be obtained in drilling, too, namely the mass per 100 representative chips can be stably and reliably reduced to 1.3 g or less, when the effective Ca concentration index [Ca]e is not more than 5 ppm. It is also evident that when the effective Ca concentration index [Ca]e is reduced to 1 ppm or less, the mass per 100 chips can be reduced to 1.0 g or less, indicating a still better chip separability.

Further, it was confirmed that when the effective Ca concentration index [Ca]e is not more than 5 ppm, a sufficient tool life can be secured.

Example 2

Using an atmosphere-controllable high frequency induction furnace, 150-kg steel ingots, having the respective chemical compositions shown in Table 5, were produced, and round bars 57 mm in diameter were obtained. The production steps were the same as in Example 1.

TABLE 5

| | Chemical composition (% by mass), balance: Fe and impurities | | | | | | | | | | |
|---|---|---|---|---|---|---|---|---|---|---|---|
| Steel | C | Si | Mn | S | P | N | Al | Ca | O | Other(s) | Ca/O |
| E1 | 0.40 | 0.20 | 0.80 | 0.050 | 0.020 | 0.008 | 0.002 | 0.0013 | 0.0023 | Ti: 0.027 | 0.565 |
| E2 | 0.20 | 1.30 | 1.80 | 0.048 | 0.018 | 0.009 | 0.003 | 0.0013 | 0.0031 | Cr: 1.2 | 0.419 |
| E3 | 0.20 | 1.80 | 1.20 | 0.049 | 0.019 | 0.012 | 0.003 | 0.0015 | 0.0026 | V: 0.15 | 0.577 |
| E4 | 0.21 | 0.20 | 0.90 | 0.051 | 0.020 | 0.008 | 0.018 | 0.0009 | 0.0021 | Mo: 0.20 | 0.429 |
| E5 | 0.22 | 0.20 | 0.81 | 0.049 | 0.020 | 0.009 | 0.002 | 0.0021 | 0.0030 | Nb: 0.018 | 0.700 |
| E6 | 0.20 | 0.20 | 0.79 | 0.048 | 0.019 | 0.008 | 0.002 | 0.0017 | 0.0025 | Cu: 0.40 | 0.680 |
| E7 | 0.21 | 0.22 | 0.82 | 0.050 | 0.020 | 0.009 | 0.021 | 0.0008 | 0.0026 | Ni: 0.20 | 0.308 |
| E8 | 0.40 | 0.20 | 0.81 | 0.050 | 0.020 | 0.008 | 0.002 | 0.0021 | 0.0030 | Ti: 0.021 | 0.700 |
| E9 | 0.20 | 1.30 | 1.79 | 0.048 | 0.018 | 0.009 | 0.003 | 0.0020 | 0.0023 | Cr: 1.18 | 0.870 |
| E10 | 0.20 | 1.80 | 1.18 | 0.049 | 0.019 | 0.012 | 0.003 | 0.0023 | 0.0021 | V: 0.14 | 1.095 |
| E11 | 0.21 | 0.20 | 0.88 | 0.049 | 0.020 | 0.008 | 0.022 | 0.0023 | 0.0023 | Mo: 0.20 | 1.000 |
| E12 | 0.20 | 0.20 | 0.80 | 0.051 | 0.020 | 0.008 | 0.002 | 0.0030 | 0.0025 | Nb: 0.017 | 1.200 |
| E13 | 0.20 | 0.20 | 0.80 | 0.049 | 0.019 | 0.009 | 0.002 | 0.0030 | 0.0026 | Cu: 0.41 | 1.154 |
| E14 | 0.21 | 0.22 | 0.81 | 0.051 | 0.020 | 0.009 | 0.023 | 0.0027 | 0.0025 | Ni: 0.20 | 1.080 |
| E15 | 0.21 | 0.21 | 0.79 | 0.051 | 0.019 | 0.016 | 0.002 | 0.0018 | 0.0028 | Cr: 0.15, V: 0.10 | 0.643 |
| E16 | 0.20 | 0.20 | 0.80 | 0.049 | 0.020 | 0.017 | 0.003 | 0.0032 | 0.0022 | Cr: 0.15, V: 0.10 | 1.455 |

The thus-obtained round bars were examined for effective Ca concentration index [Ca]e and chip separability by the methods described above in Example 1.

The $(O)_{ox}$ and $(Ca)_{ox}$ values and the effective Ca concentration index [Ca]e data obtained by the conventional methods using an EDX, as already mentioned, are shown in Table 6. Also shown in the same table are the results of chip separability evaluation, by turning and by drilling, as expressed in terms of the mass per 10 representative chips in the case of turning, and in terms of the mass per 100 representative chips in the case of drilling.

TABLE 6

| | Proportion of Ca or O contained in oxide inclusions | | [Ca]e | Chip mass in turning | Chip mass in drilling (g/100 |
|---|---|---|---|---|---|
| Steel | $(Ca)_{ox}$ | $(O)_{ox}$ | (ppm) | (g/10 chips) | chips) |
| E1 | 0.286 | 0.42 | −2.65 | 8.1 | 0.62 |
| E2 | 0.293 | 0.42 | −8.62 | 7.6 | 0.54 |
| E3 | 0.271 | 0.43 | −1.41 | 8.5 | 0.70 |
| E4 | 0.286 | 0.41 | −5.63 | 6.8 | 0.67 |
| E5 | 0.286 | 0.42 | 0.59 | 10.3 | 0.91 |
| E6 | 0.293 | 0.42 | −0.43 | 9.8 | 0.82 |
| E7 | 0.136 | 0.44 | −0.02 | 10.1 | 0.80 |
| E8 | 0.093 | 0.45 | 14.81 | 49.2 | 1.87 |
| E9 | 0.243 | 0.44 | 7.31 | 18.0 | 1.23 |
| E10 | 0.279 | 0.41 | 8.73 | 38.0 | 1.54 |
| E11 | 0.150 | 0.42 | 14.79 | 38.0 | 2.00 |
| E12 | 0.271 | 0.43 | 14.22 | 45.0 | 1.64 |
| E13 | 0.279 | 0.42 | 12.76 | 48.0 | 1.90 |
| E14 | 0.236 | 0.43 | 13.30 | 42.0 | 1.55 |
| E15 | 0.271 | 0.43 | 0.33 | 9.0 | 0.90 |
| E16 | 0.264 | 0.43 | 18.48 | 55.0 | 2.10 |

Figure 10:
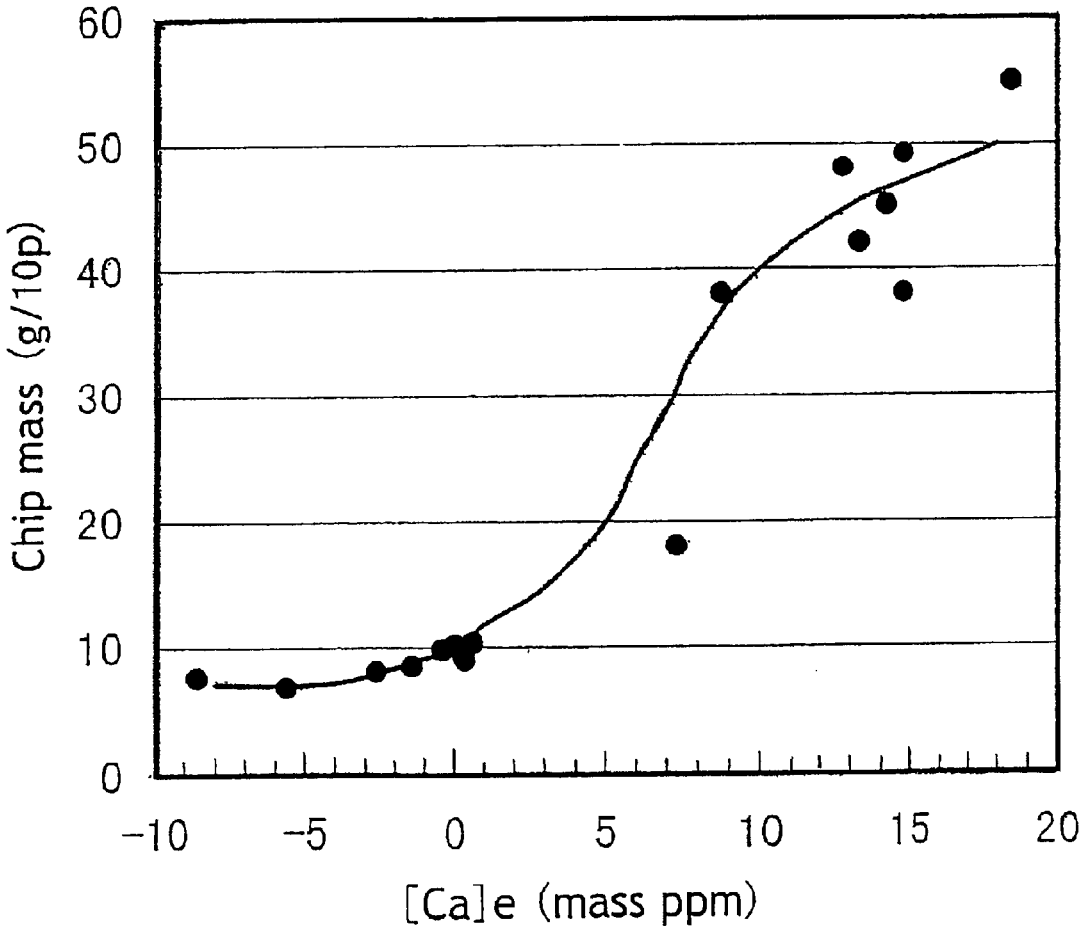
FIG. 10 is another graphic representation of the relationship between effective Ca concentration index [Ca]e and chip separability in turning.
Figure 11:
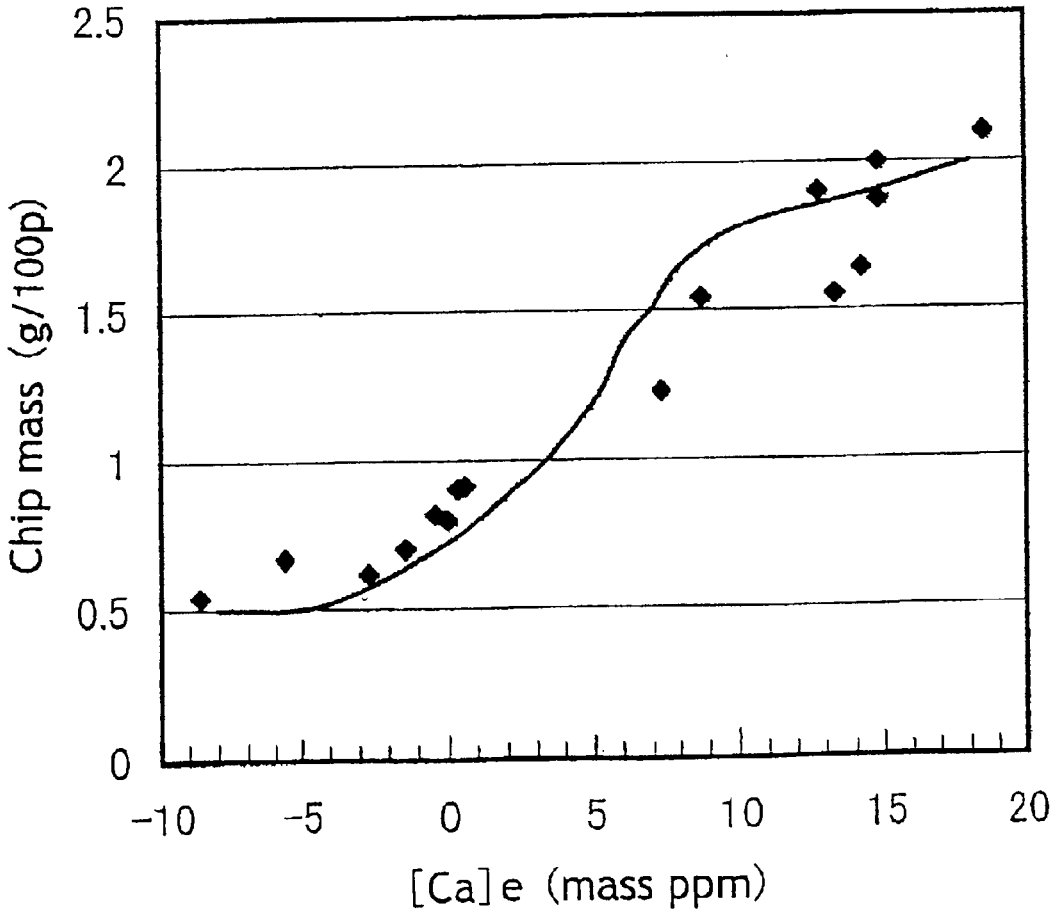
FIG. 11 is another graphic representation of the relationship between effective Ca concentration index [Ca]e and chip separability in drilling.

The relationship between the effective Ca concentration index [Ca]e and chip separability is shown in FIG. 10 and in FIG. 11. In FIG. 10, the ordinate denotes the mass per 10 chips, expressed as "g/10 p" and, in FIG. 11, the ordinate denotes the mass per 100 chips, expressed as "g/100 p".

From each figure, it is evident that when the effective Ca concentration index [Ca]e is not more than 5 ppm, good chip separability can be secured stably and reliably.

Thus, from FIG. 10 showing the relationship between the effective Ca concentration index [Ca]e and chip separability in turning, it is evident that when the effective Ca concentration index [Ca]e is reduced to 5 ppm or less, the mass per 10 representative chips can be stably and reliably reduced to 20 g or less, hence good chip separability can be attained and, in particular when the effective Ca concentration index [Ca]e is reduced to 1 ppm or less, the mass per 10 chips can be reduced to about 10 g, which indicates a still better chip separability.

Further, from FIG. 11 showing the relationship between the effective Ca concentration index [Ca]e and chip separability in drilling, it is evident that when the effective Ca concentration index [Ca]e is reduced to 5 ppm or less, the mass per 100 representative chips stably and reliably satisfies the requirement, namely not more than 1.3 g, hence good chip separability can be obtained in drilling as well and, in particular when the effective Ca concentration index [Ca]e is not more than 1 ppm, the mass per 100 chips becomes not more than 1.0 g, which indicates a still better chip separability.

It was confirmed that, like in Example 1, a satisfactory tool life can be secured when the effective Ca concentration index [Ca]e is not more than 5 ppm.

Example 3

Using an atmosphere-controllable high frequency induction furnace, 150-kg steel ingots, having the respective chemical compositions shown in Table 7, were produced, and round bars 57 mm in diameter were obtained. The production steps were the same as in Examples 1 and 2.

TABLE 7

| | Chemical composition (% by mass), balances Fe and impurities | | | | | | | | | | | | | |
|---|---|---|---|---|---|---|---|---|---|---|---|---|---|---|
| Steel | C | Si | Mn | S | P | N | Al | Cr | V | Ti | Ca | O | Other(s) | Ca/O |
| F1 | 0.39 | 0.26 | 0.81 | 0.048 | 0.018 | 0.012 | 0.001 | — | — | — | 0.0018 | 0.0026 | Se: 0.004 | 0.692 |
| F2 | 0.40 | 1.31 | 0.82 | 0.050 | 0.015 | 0.008 | 0.002 | 0.16 | 0.08 | — | 0.0009 | 0.0022 | Te: 0.0031 | 0.409 |
| F3 | 0.41 | 0.22 | 0.79 | 0.050 | 0.014 | 0.009 | 0.019 | 0.16 | 0.08 | — | 0.0011 | 0.0023 | Bi: 0.08 | 0.478 |
| F4 | 0.40 | 0.21 | 0.79 | 0.048 | 0.020 | 0.016 | 0.002 | — | — | — | 0.0009 | 0.0033 | Mg: 0.0015 | 0.273 |
| F5 | 0.40 | 0.24 | 0.80 | 0.052 | 0.020 | 0.017 | 0.024 | 0.05 | — | 0.010 | 0.0014 | 0.0025 | REM: 0.0025 | 0.560 |
| F6 | 0.38 | 0.25 | 0.77 | 0.048 | 0.015 | 0.008 | 0.002 | — | — | — | 0.0026 | 0.0034 | Se: 0.0041 | 0.765 |
| F7 | 0.39 | 1.28 | 0.75 | 0.051 | 0.015 | 0.009 | 0.001 | 0.16 | 0.07 | — | 0.0022 | 0.0026 | Te: 0.003 | 0.846 |
| F8 | 0.39 | 0.26 | 0.79 | 0.052 | 0.014 | 0.012 | 0.021 | 0.16 | 0.08 | — | 0.0017 | 0.0018 | Bi: 0.07 | 0.944 |
| F9 | 0.40 | 0.25 | 0.76 | 0.049 | 0.016 | 0.018 | 0.002 | — | — | — | 0.0018 | 0.0021 | Mg: 0.0014 | 0.857 |
| F10 | 0.41 | 0.26 | 0.81 | 0.050 | 0.015 | 0.017 | 0.023 | 0.05 | — | 0.009 | 0.0031 | 0.0023 | REM: 0.0031 | 1.348 |
| F11 | 0.40 | 0.24 | 0.80 | 0.050 | 0.015 | 0.016 | 0.002 | — | — | — | 0.0018 | 0.0026 | Se: 0.003, Te: 0.004 | 0.692 |
| F12 | 0.40 | 0.24 | 0.80 | 0.049 | 0.016 | 0.016 | 0.002 | — | — | — | 0.0021 | 0.0028 | Te: 0.003, Bi: 0.02 | 0.750 |
| F13 | 0.41 | 0.25 | 0.81 | 0.050 | 0.015 | 0.016 | 0.002 | 0.16 | 0.09 | — | 0.0023 | 0.0031 | Te: 0.002, Bi: 0.03 | 0.742 |
| F14 | 0.40 | 0.24 | 0.80 | 0.049 | 0.015 | 0.016 | 0.002 | — | — | — | 0.0030 | 0.0030 | Se: 0.003, Te: 0.004 | 1.000 |
| F15 | 0.39 | 0.24 | 0.81 | 0.050 | 0.017 | 0.016 | 0.002 | — | — | — | 0.0031 | 0.0025 | Te: 0.003, Bi: 0.02 | 1.240 |
| F16 | 0.40 | 0.25 | 0.80 | 0.050 | 0.015 | 0.016 | 0.002 | 0.16 | 0.09 | — | 0.0027 | 0.0031 | Te: 0.004, Bi: 0.03 | 0.871 |

The thus-obtained round bars were examined for effective Ca concentration index [Ca]e and chip separability by the methods described above in Examples 1 and 2.

The $(O)_{ox}$ and $(Ca)_{ox}$ values and the effective Ca concentration index [Ca]e data obtained by the conventional methods using an EDX, as already mentioned, are shown in Table 8. Also shown in the same table are the results of chip separability evaluation, by turning and by drilling, as expressed in terms of the mass per 10 representative chips in the case of turning, and in terms of the mass per 100 representative chips in the case of drilling.

TABLE 8

| | Proportion of Ca or O contained in oxide inclusions | | [Ca]e | Chip mass in turning | Chip mass in drilling (g/100 |
|---|---|---|---|---|---|
| Steel | $(Ca)_{ox}$ | $(O)_{ox}$ | (ppm) | (g/10 chips) | chips) |
| F1 | 0.293 | 0.44 | 0.69 | 4.7 | 0.45 |
| F2 | 0.293 | 0.43 | −5.98 | 3.8 | 0.33 |
| F3 | 0.193 | 0.42 | 0.44 | 5.1 | 0.44 |
| F4 | 0.136 | 0.43 | −1.42 | 6.6 | 0.61 |
| F5 | 0.229 | 0.43 | 0.71 | 6.1 | 0.66 |

TABLE 8-continued

| | Proportion of Ca or O contained in oxide inclusions | | [Ca]e | Chip mass in turning | Chip mass in drilling (g/100 |
|---|---|---|---|---|---|
| Steel | $(Ca)_{ox}$ | $(O)_{ox}$ | (ppm) | (g/10 chips) | chips) |
| F6 | 0.243 | 0.39 | 4.83 | 19.0 | 1.27 |
| F7 | 0.264 | 0.43 | 6.02 | 21.0 | 1.38 |
| F8 | 0.150 | 0.41 | 10.41 | 22.0 | 1.33 |
| F9 | 0.050 | 0.42 | 15.50 | 41.0 | 1.80 |
| F10 | 0.207 | 0.42 | 19.66 | 49.0 | 1.97 |
| F11 | 0.286 | 0.42 | 0.31 | 9.0 | 0.68 |
| F12 | 0.279 | 0.43 | 2.86 | 13.0 | 1.00 |
| F13 | 0.264 | 0.44 | 4.38 | 19.0 | 1.20 |
| F14 | 0.286 | 0.41 | 9.09 | 36.0 | 1.60 |

TABLE 8-continued

| | Proportion of Ca or O contained in oxide inclusions | | [Ca]e | Chip mass in turning | Chip mass in drilling (g/100 |
|---|---|---|---|---|---|
| Steel | $(Ca)_{ox}$ | $(O)_{ox}$ | (ppm) | (g/10 chips) | chips) |
| F15 | 0.286 | 0.41 | 13.58 | 44.0 | 1.80 |
| F16 | 0.264 | 0.44 | 7.95 | 22.0 | 1.55 |

Figure 12:
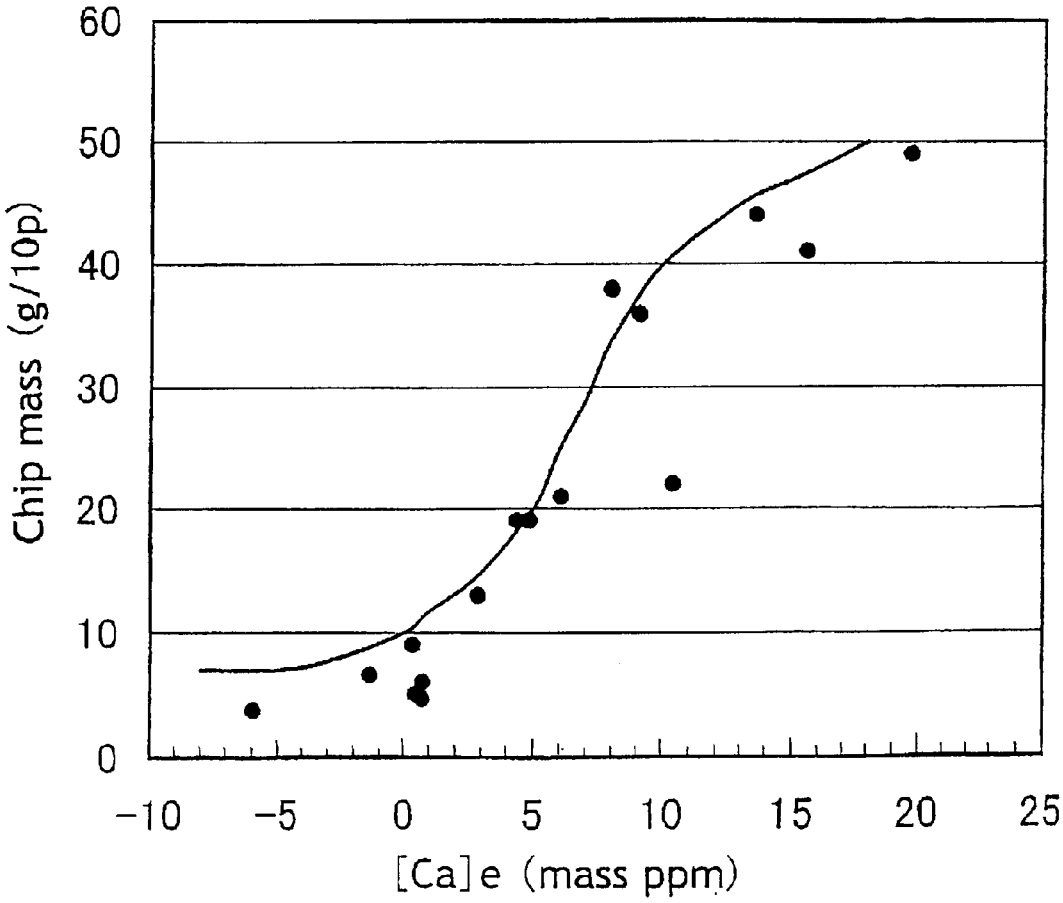
FIG. 12 is further another graphic representation of the relationship between effective Ca concentration index [Ca]e and chip separability in turning.
Figure 13:
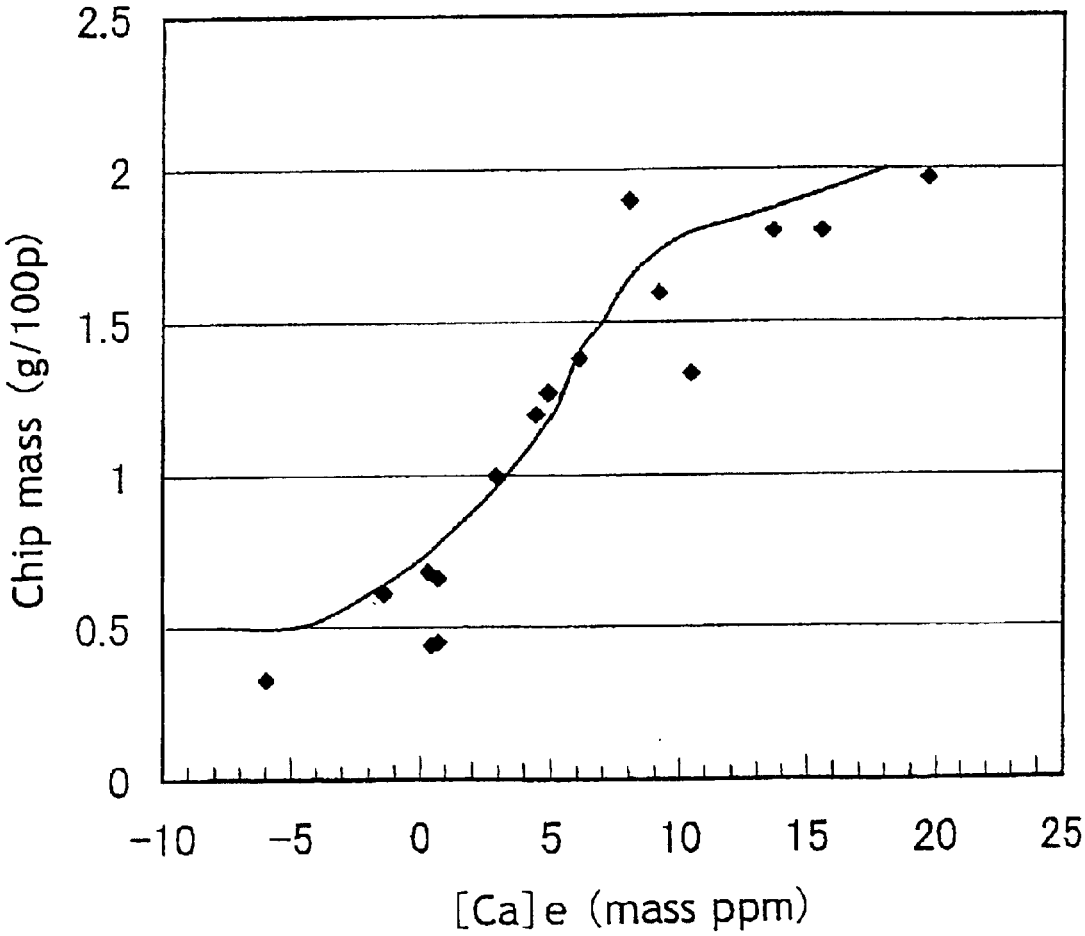
FIG. 13 is further another graphic representation of the relationship between effective Ca concentration index [Ca]e and chip separability in drilling.

The relationship between the effective Ca concentration index [Ca]e and chip separability is shown in FIG. 12 and in FIG. 13. In FIG. 12, the ordinate denotes the mass per 10 chips, expressed as "g/10 p" and, in FIG. 13, the ordinate denotes the mass per 100 chips, expressed as "g/100 p".

From each figure, it is evident that when the effective Ca concentration index [Ca]e is not more than 5 ppm, good chip separability can be secured stably and reliably.

Thus, from FIG. 12 showing the relationship between the effective Ca concentration index [Ca]e and chip separability in turning, it is evident that when the effective Ca concentration index [Ca]e is reduced to 5 ppm or less, the mass per 10 representative chips stably and reliably satisfies the requirement that it should be not more than 20 g, hence good chip separability can be attained and, in particular when the effective Ca concentration index [Ca]e is reduced to 1 ppm or less, the mass per 10 chips can be reduced to about 10 g, which indicates a still better chip separability.

Further, from FIG. 13 showing the relationship between the effective Ca concentration index [Ca]e and chip separability in drilling, it is evident that when the effective Ca concentration index [Ca]e is reduced to 5 ppm or less, the mass per 100 representative chips can be reduced to 1.3 g or less, hence good chip separability can be obtained in drilling as well and, in particular when the effective Ca concentration index [Ca]e is not more than 1 ppm, the mass per 100 chips becomes not more than 1.0 g, which indicates a still better chip separability.

It was confirmed that, like in Examples 1 and 2, a satisfactory tool life can be secured when the effective Ca concentration index [Ca]e is not more than 5 ppm.

Example 4

A steel for machine structural use, which had C, Si, Mn, S, P, N, Al and Cr contents of 0.53%, 0.22%, 0.75%, 0.05%, 0.02%, 0.017%, 0.002% and 0.1%, was produced by treating 70 tons of a molten steel in the steps of basic oxygen furnace treatment, secondary refining and continuous casting.

On the occasion of tapping from the basic oxygen furnace to a ladle, the contents of C, Si, Mn, S, P, N and Cr were adjusted and, after deslagging and synthetic slag addition, the ladle was conveyed to a secondary refining step, where arc heating equipment was provided and porous gas stirring was possible, and temperature was raised by arc heating and gas stirring with Ar gas were carried out appropriately, followed by further composition adjustment. Then, CaSi ferroalloy wires were added to a predetermined Ca content level and the secondary refining was finished by 2 minutes of stirring. The conditions of gas stirring of the molten steel and the Ca addition conditions as employed on that occasion are shown in Table 9.

TABLE 9

| | Gas blowing conditions | | | Molten steel conditions | | | | Ca | |
|---|---|---|---|---|---|---|---|---|---|
| | Gas amount Q ($m^3/s$) | Depth H (m) | Gas temperature $T_G$ (K) | Molten steel amount $W_L$ (t) | Molten steel temperature $T_L$ (K) | Atmosphere pressure P ($N/m^2$) | Stirring energy $\epsilon$ (W/t) | addition amount $\alpha$ (g/t) | Value of A ($\epsilon/\alpha$) |
| Example according to Invention | 0.002 | 2.53 | 298 | 74 | 1823 | $1.01 \times 10^5$ | 32 | 250 | 7.8 |
| Comparative Example | 0.001 | 2.53 | 298 | 70 | 1823 | $1.01 \times 10^5$ | 17 | 400 | 23.5 |

(Note) The unit "$m^3/s$" in the gas amount column means "$m^3$ (normal)/s".

The molten steel after secondary refining was made into a bloom (420 mm×320 mm) by the conventional method of continuous casting, followed by blooming and hot forging, which were carried out in the conventional manner, to give a round bar with a diameter of 80 mm. The heating temperature, in the step of hot forging, was 1473K and the forging finishing temperature was not less than 1273K. The cooling after hot forging was allowed to proceed in the manner of atmospheric cooling.

Using the thus-obtained round bar 80 mm in diameter, the effective Ca concentration index [Ca]e was examined.

Thus, test specimens with the L cross section serving as the test face were prepared from the above round bar, and the $(O)_{ox}$ and $(Ca)_{ox}$ values were determined by the conventional method using an EDX, as already mentioned above. Then, the effective Ca concentration index [Ca]e was calculated using these values and the Ca content and O (oxygen) content in each expressed in ppm by mass.

The results of the above effective Ca concentration index [Ca]e examination are shown in Table 10. Also shown in Tale 10 are the O (oxygen) content and Ca content in ppm by mass, namely T.[O] and T.[Ca].

TABLE 10

| | T. [0] (ppm) | T. [Ca] (ppm) | [Ca]e (ppm) |
|---|---|---|---|
| Example according to Invention | 35 | 27 | −3 |
| Comparative Example | 42 | 37 | 5.1 |

As shown in Table 9, the stirring energy $\epsilon$ values for the molten steels in this example, according to the present invention, and a comparative example were 32 W/t and 17 W/t, respectively, and were within the range specified above in (III). On the other hand, the value of A defined by the formula (4) given above was 7.8 in this example, according to the present invention, hence within the range specified above in (III), while it was as high as 23.5 in the comparative example and outside the range specified above in (III).

As a result, as is evident from Table 10, the effective Ca concentration index [Ca]e was −3 ppm in the case of this example according to the present invention. In the comparative example, the effective Ca concentration index [Ca]e was 5.1 ppm.

Example 5

Using a 3-ton atmospheric induction furnace, steel compositions having the respective chemical compositions shown in Table 11 and Table 12 were melted and 3-ton steel ingots were prepared. For each steel, the O (oxygen) content was adjusted by adjusting the levels of addition of Al, Si and Mn, and a CaSi ferroalloy was added just prior to pouring into a mold and the Ca content was adjusted by varying the level of addition thereof.

TABLE 11

| Steel | Chemical composition (% by mass), balance: Fe and impurities | | | | | | | | | | | |
|---|---|---|---|---|---|---|---|---|---|---|---|---|
| | C | Si | Mn | S | P | N | Al | Pb | Ca | O | Other(s) | Ca/O |
| MD1 | 0.40 | 0.20 | 0.75 | 0.051 | 0.024 | 0.0175 | 0.002 | — | 0.0008 | 0.0045 | Ti: 0.015 | 0.178 |
| MD2 | 0.21 | 0.05 | 0.65 | 0.105 | 0.005 | 0.0150 | 0.021 | — | 0.0010 | 0.0024 | Cr: 1.01, Mo: 0.52 | 0.417 |
| MD3 | 0.42 | 0.71 | 1.52 | 0.119 | 0.027 | 0.0121 | 0.004 | — | 0.0022 | 0.0036 | V: 0.31 | 0.611 |
| MD4 | 0.35 | 0.18 | 0.91 | 0.015 | 0.012 | 0.0041 | 0.035 | — | 0.0008 | 0.0021 | Nb: 0.032 | 0.381 |
| MD5 | 0.18 | 0.05 | 1.50 | 0.025 | 0.017 | 0.0043 | 0.003 | — | 0.0028 | 0.0036 | Cu: 0.21, Ni: 0.42 | 0.778 |
| ME1 | 0.48 | 0.25 | 0.81 | 0.048 | 0.014 | 0.0038 | 0.009 | — | 0.0014 | 0.0031 | Se: 0.008 | 0.452 |
| ME2 | 0.47 | 0.21 | 0.82 | 0.049 | 0.015 | 0.0041 | 0.005 | — | 0.0015 | 0.0035 | Te: 0.0012 | 0.429 |
| ME3 | 0.48 | 0.22 | 0.81 | 0.047 | 0.015 | 0.0039 | 0.002 | — | 0.0014 | 0.0041 | Bi: 0.05 | 0.341 |
| ME4 | 0.49 | 0.19 | 0.82 | 0.050 | 0.014 | 0.0042 | 0.003 | — | 0.0006 | 0.0031 | Mg: 0.0015 | 0.194 |
| ME5 | 0.48 | 0.20 | 0.82 | 0.051 | 0.015 | 0.0038 | 0.003 | — | 0.0015 | 0.0022 | REM: 0.0025 | 0.682 |
| MDE1 | 0.40 | 0.21 | 0.75 | 0.045 | 0.023 | 0.0180 | 0.002 | — | 0.0012 | 0.0061 | V: 0.12, Se: 0.005 | 0.197 |
| MDE2 | 0.41 | 0.25 | 0.74 | 0.051 | 0.025 | 0.0124 | 0.032 | — | 0.0009 | 0.0017 | Cr: 0.3,V: 0.05, Bi: 0.06 | 0.529 |

TABLE 12

| Steel | Chemical composition (% by mass), balance: Fe and impurities | | | | | | | | | | | |
|---|---|---|---|---|---|---|---|---|---|---|---|---|
| | C | Si | Mn | S | P | N | Al | Pb | Ca | O | Other(s) | Ca/O |
| MD6 | 0.41 | 0.19 | 0.76 | 0.049 | 0.022 | 0.0177 | 0.003 | — | 0.0031 | 0.0029 | Ti: 0.013 | 1.069 |
| MD7 | 0.20 | 0.005 | 0.67 | 0.108 | 0.006 | 0.0151 | 0.022 | — | 0.0022 | 0.0019 | Cr:1.02,Mo: 0.49 | 1.158 |
| MD8 | 0.41 | 0.72 | 1.53 | 0.122 | 0.029 | 0.0122 | 0.005 | — | 0.0025 | 0.0041 | V: 0.32 | 0.610 |
| MD9 | 0.34 | 0.19 | 0.90 | 0.0014 | 0.014 | 0.0038 | 0.031 | — | 0.0030 | 0.0022 | Hb: 0.027 | 1.364 |
| MD10 | 0.19 | 0.06 | 1.51 | 0.026 | 0.019 | 0.0045 | 0.002 | — | 0.0015 | 0.0036 | Cu: 0.20, Ni: 0.45 | 0.417 |
| ME6 | 0.49 | 0.24 | 0.82 | 0.051 | 0.015 | 0.0041 | 0.003 | — | 0.0027 | 0.0031 | Se: 0.007 | 0.871 |
| ME7 | 0.47 | 0.22 | 0.81 | 0.048 | 0.014 | 0.0039 | 0.004 | — | 0.0025 | 0.0051 | Te: 0.0010 | 0.490 |
| ME8 | 0.47 | 0.23 | 0.81 | 0.049 | 0.015 | 0.0040 | 0.003 | — | 0.0022 | 0.0019 | Bi: 0.06 | 1.158 |
| ME9 | 0.48 | 0.22 | 0.82 | 0.049 | 0.015 | 0.0041 | 0.002 | — | 0.0019 | 0.0018 | Mg: 0.0019 | 1.056 |
| ME10 | 0.49 | 0.21 | 0.81 | 0.050 | 0.014 | 0.0043 | 0.001 | — | 0.0017 | 0.0019 | REM: 0.0029 | 0.895 |

Then, these steels were heated to 1523K and subjected to hot rolling, with a finishing temperature of 1273K, to give round bars with a diameter of 80 mm. The round bars were then subjected to normalization by heating to 1153K and maintaining at that temperature for 2 hours.

Using the thus-obtained round bar of each steel, the area percentage of eutectic MnS type sulfides, the proportion of MnO contained in oxide inclusions, the chip separability and the tool life were examined.

Thus, test specimens with the L cross section serving as the test face were prepared from each round bar 80 mm in diameter and, after mirror-like polishing, the proportion of MnO contained in oxide inclusions was determined by the conventional method using an EDX, as already mentioned above.

Further, 12 fields of the mirror-like polished L cross section, namely the test face, were observed by an optical microscope with a magnification of 200, and the area percentage of eutectic MnS type sulfides was determined.

The chip separability was evaluated by turning. Thus, turning was carried out using a tip for the carbide tool P20 in a dry lubrication system at a depth of a cut of 2.0 mm, a feed of 0.25 mm/rev, and a cutting speed of 160 m/min, and the mass per 10 representative chips was measured for chip separability evaluation. The tool life was also examined when turning was carried out under the above conditions. The tool life was defined as the time until the wear of the flank amounted to 0.2 mm.

Figure 14:
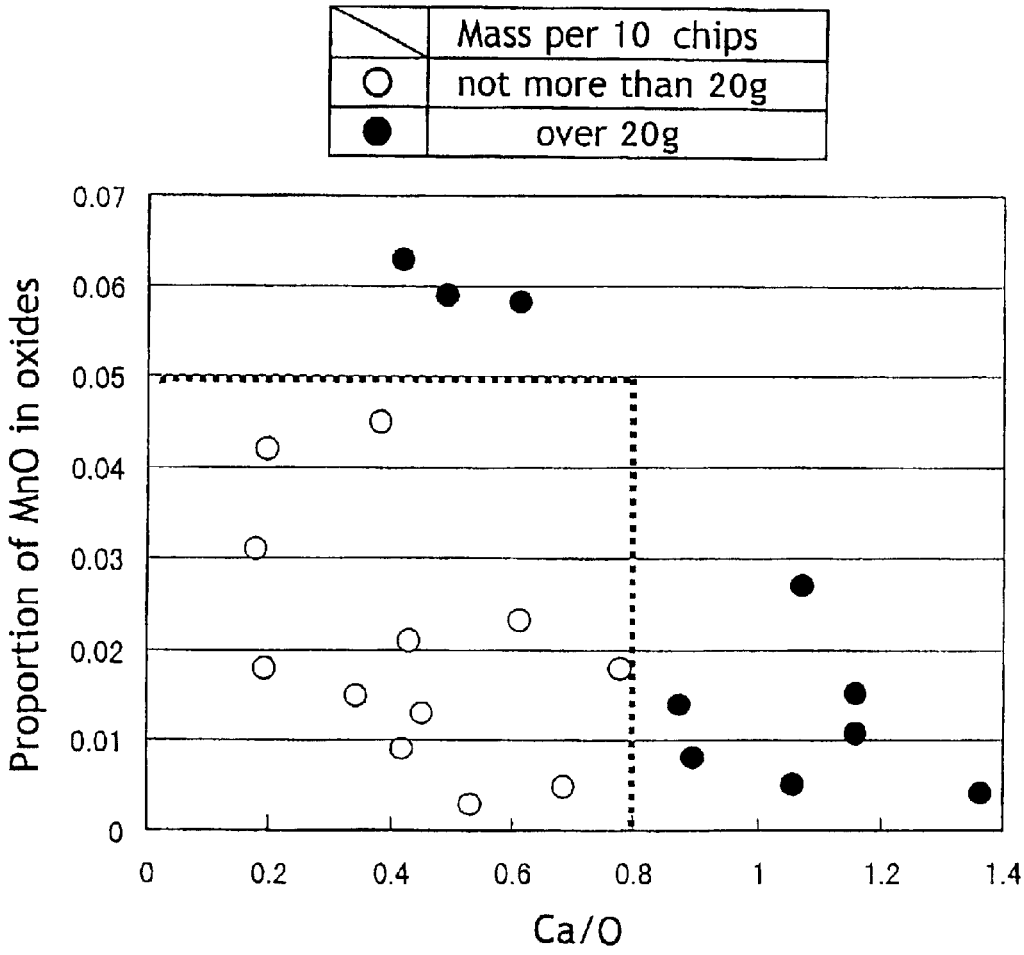
FIG. 14 is another graphic representation of the effects of the proportion of MnO contained in oxide inclusions and the value of Ca/O on the chip separability.

The results of the above various tests are shown in Table 13. FIG. 14 is a graphic representation of the effects of the proportion of MnO contained in oxide inclusions and the value of Ca/O on the chip separability. In FIG. 14, the ordinate denotes the proportion of MnO contained in oxide inclusions, expressed as "proportion of MnO in oxides". The data satisfying the requirement that the mass per 10 chips should be not more than 20 g were plotted by the mark "○" and the results exceeding 20 g per 10 chips and thus failing to accomplish the goal by the mark "●",

TABLE 13

| Steel | Proportion of MnO contained in oxide inclusions | Area percentage (%) of eutectic MnS type sulfides | Chip mass (g/10 chips) |
|---|---|---|---|
| MD1 | 0.031 | 99 | 5.4 |
| MD2 | 0.009 | 92 | 6.4 |
| MD3 | 0.023 | 83 | 8.6 |
| MD4 | 0.045 | 75 | 11.1 |
| MD5 | 0.018 | 81 | 7.5 |
| MEl | 0.013 | 97 | 6.9 |
| ME2 | 0.021 | 90 | 7.6 |
| ME3 | 0.015 | 99 | 5.5 |
| ME4 | 0.018 | 99 | 5.1 |
| ME5 | 0.005 | 91 | 8.3 |
| MDE1 | 0.042 | 64 | 12.8 |
| MDE2 | 0.003 | 52 | 8.9 |
| MD6 | 0.027 | 13 | 28.5 |
| MD7 | 0.011 | 17 | 27.4 |
| MD8 | 0.058 | 12 | 27.8 |
| MD9 | 0.004 | 3 | 31.5 |
| MD10 | 0.063 | 22 | 26.5 |
| ME6 | 0.014 | 31 | 23.0 |
| ME7 | 0.059 | 21 | 24.7 |
| ME8 | 0.015 | 5 | 20.4 |
| ME9 | 0.005 | 18 | 23.3 |
| ME10 | 0.008 | 25 | 20.1 |

From Table 13, and FIG. 14 showing the effects of the proportion of MnO contained in oxide inclusions and the value of Ca/O on chip separability, it is evident that when the requirements that the value of Ca/O should be not more than 0.8, and the proportion of MnO contained in oxide inclusions should be not more than 0.05 are satisfied, the mass per 10 chips is not more than 20 g, hence good chip separability is attained. It was confirmed that, in this case, the tool life was not shorter than 15 minutes and, accordingly, the goal was accomplished.

INDUSTRIAL APPLICABILITY

The steel for machine structural use, according to the present invention, is excellent in machinability, in particular in chip separability, which is required in automated working lines, and is also excellent from the viewpoint of the tool life in cutting working using carbide tools. Therefore, it can be used as a steel stock for various machine structural steel parts, such as in industrial machinery, construction machinery and conveying machinery such as automobiles. Furthermore, the steel for machine structural use, according to the invention, is substantially free of Pb and therefore suited for use as a steel friendly to the global environment.

What is claimed is:

1. A steel for machine structural use which comprises, on the percent by mass basis, C: 0.1 to 0.6%, Si: 0.01 to 2.0%, Mn: 0.2 to 2.0%, S: 0.005 to 0.20%, P: not more than 0.1%, Ca: 0.0001 to 0.01%, N: 0.001 to 0.02% and Al: not more than 0.1%, with the balance being Fe and impurities, the effective Ca concentration index defined by the formula (1) given below being not more than 5 ppm by mass:

$$[Ca]e=T.[Ca]-(T.[O]/(O)_{ox})\times(Ca)_{ox} \quad (1)$$

in which the symbols are defined as follows:

[Ca]e: effective Ca concentration index (ppm by mass);

T.[Ca]: Ca content in ppm by mass;

T.[O]: O (oxygen) content in ppm by mass;

$(O)_{ox}$: proportion of O (oxygen) contained in oxide inclusions;

$(Ca)_{ox}$: proportion of Ca contained in oxide inclusions.

2. A steel for machine structural use according to claim 1, which further contains one or more elements selected from among Ti: not more than 0.1%, Cr: not more than 2.5%, V: not more than 0.5%, Mo: not more than 1.0%, Nb: not more than 0.1%, Cu: not more than 1.0% and Ni: not more than 2.0% in lieu of part of Fe.

3. A steel for machine structural use according to claim 1, which further contains one or more elements selected from among Se: not more than 0.01%, Te: not more than 0.01%, Bi: not more than 0.1%, Mg: not more than 0.01% and REM (rare earth elements): not more than 0.01% in lieu of part of Fe.

4. A steel for machine structural use according to claim 1, which further contains one or more elements selected from among Ti: not more than 0.1%, Cr: not more than 2.5%, V: not more than 0.5%, Mo: not more than 1.0%, Nb: not more than 0.1%, Cu: not more than 1.0% and Ni: not more than 2.0% and one or more elements selected from among Se: not more than 0.01%, Te: not more than 0.01%, Bi: not more than 0.1%, Mg: not more than 0.01% and REM (rare earth elements): not more than 0.01% in lieu of part of Fe.

5. A steel for machine structural use according to claim 1 in which the Ca content is 0.0001 to 0.0048% and the content of O (oxygen) in impurities is 0.002 to 0.006%.

6. A steel for machine structural use according to claim 2 in which the Ca content is 0.0001 to 0.0048% and the content of O (oxygen) in impurities is 0.002 to 0.006%.

7. A steel for machine structural use according to claim 3 in which the Ca content is 0.0001 to 0.0048% and the content of O (oxygen) in impurities is 0.002 to 0.006%.

8. A steel for machine structural use according to claim 4 in which the Ca content is 0.0001 to 0.0048% and the content of O (oxygen) in impurities is 0.002 to 0.006%.

* * * * *